US011693346B2

(12) United States Patent
Suzuki

(10) Patent No.: US 11,693,346 B2
(45) Date of Patent: Jul. 4, 2023

(54) IMAGE FORMING APPARATUS CAPABLE OF ADJUSTING TENSION OF ENDLESS BELT

(71) Applicant: HEWLETT-PACKARD DEVELOPMENT COMPANY, L.P., Spring, TX (US)

(72) Inventor: Yasuo Suzuki, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/666,954

(22) Filed: Feb. 8, 2022

(65) Prior Publication Data

US 2023/0009394 A1 Jan. 12, 2023

(30) Foreign Application Priority Data

Jul. 8, 2021 (JP) ..... 2021-113281

(51) Int. Cl.
*G03G 15/20* (2006.01)

(52) U.S. Cl.
CPC ..... *G03G 15/2053* (2013.01); *G03G 15/2017* (2013.01); *G03G 2215/00156* (2013.01); *G03G 2215/2025* (2013.01); *G03G 2215/2041* (2013.01)

(58) Field of Classification Search
CPC . G03G 2215/00156; G03G 2215/2025; G03G 2215/2041
See application file for complete search history.

(56) References Cited

U.S. PATENT DOCUMENTS

| | | | | |
|---|---|---|---|---|
| 5,926,680 | A * | 7/1999 | Yamamoto | G03G 15/2053 399/328 |
| 5,956,553 | A * | 9/1999 | Park | G03G 15/2032 399/307 |
| 8,095,058 | B2 * | 1/2012 | Chiba | G03G 15/206 399/329 |
| 10,155,634 | B2 * | 12/2018 | Murata | B65H 1/04 |
| 10,386,764 | B2 * | 8/2019 | Kajita | G03G 15/206 |
| 10,821,745 | B2 * | 11/2020 | Miyakoshi | B65H 29/52 |
| 2010/0226700 | A1 * | 9/2010 | Yamada | G03G 15/2028 399/329 |
| 2016/0306306 | A1 * | 10/2016 | Nozawa | G03G 15/2053 |

FOREIGN PATENT DOCUMENTS

| | | |
|---|---|---|
| JP | 2013-82600 | 5/2013 |
| JP | 5459942 | 1/2014 |
| JP | 2016-215069 | 12/2016 |
| JP | 6197627 B2 | 9/2017 |

* cited by examiner

*Primary Examiner* — Arlene Heredia
(74) *Attorney, Agent, or Firm* — Foley & Lardner LLP

(57) ABSTRACT

An image forming apparatus includes an endless belt to rotate, belt rollers including a tension roller and an adjustment roller extending inside the endless belt, a nip roller extending adjacent the endless belt to form a nip between the nip roller and the endless belt, and a cam shaft that includes a nip forming cam and a tension adjustment cam. The nip forming cam moves the nip roller between a pressed position in which the nip roller is pressed against the endless belt, and a retracted position in which the nip roller is retracted from the endless belt. The tension adjustment cam moves the adjustment roller relative to the tension roller.

14 Claims, 20 Drawing Sheets

IMAGE FORMING APPARATUS CAPABLE OF ADJUSTING TENSION OF ENDLESS BELT

CROSS REFERENCE TO RELATED APPLICATIONS

This application claims the priority benefit of Japanese Patent Application No. 2021-113281 filed on Jul. 8, 2021, the contents of which are incorporated herein by reference.

BACKGROUND

An image forming apparatus includes a fixing device that heats and presses a sheet, onto which a toner image has been transferred, in order to fix the toner image to the sheet. The fixing device forms a nip between a fixing belt and a roller to fix the toner image.

DETAILED DESCRIPTION

Figure 1:
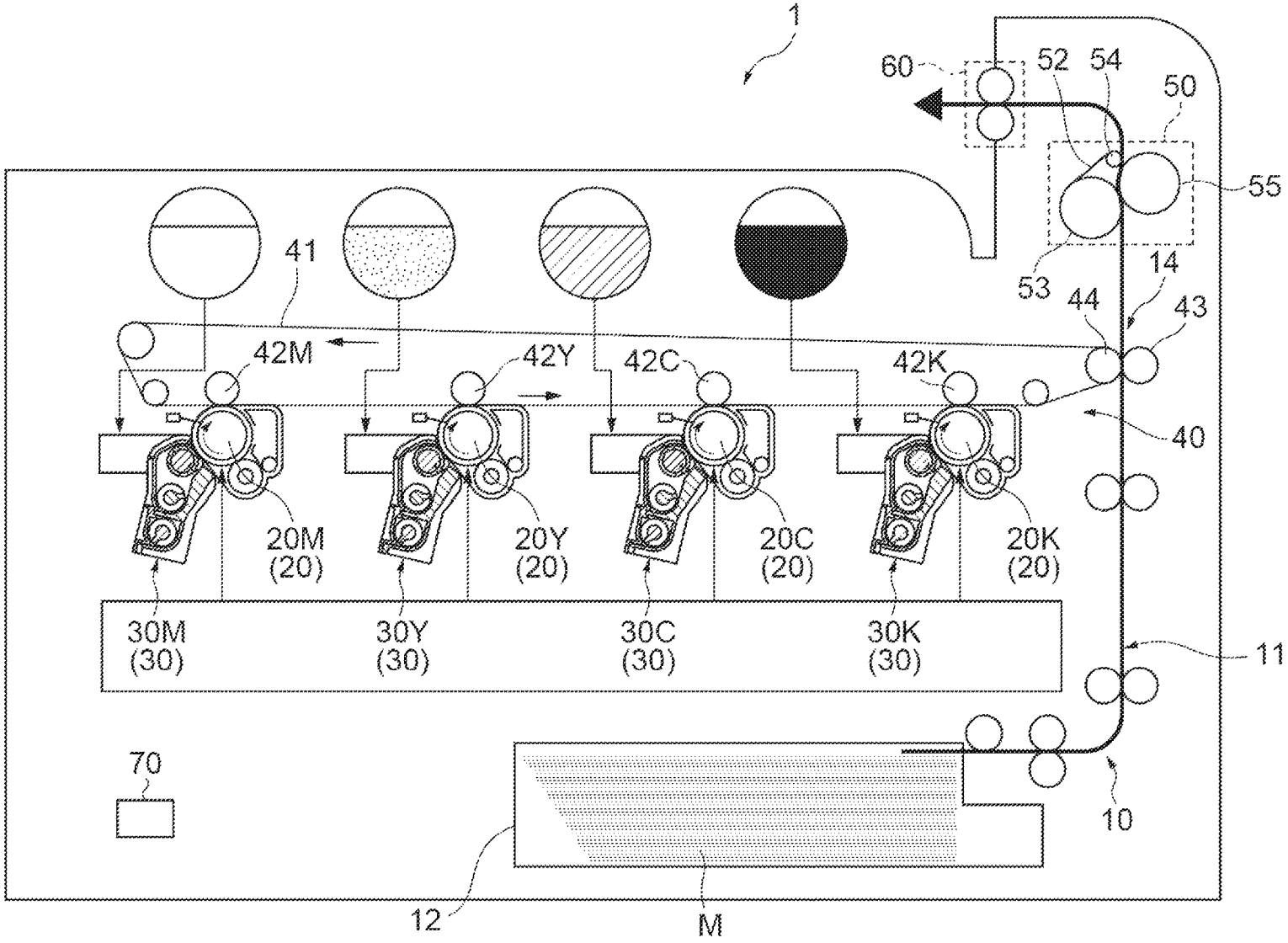
FIG. 1 is a schematic diagram of an example image forming apparatus.
Figure 2:
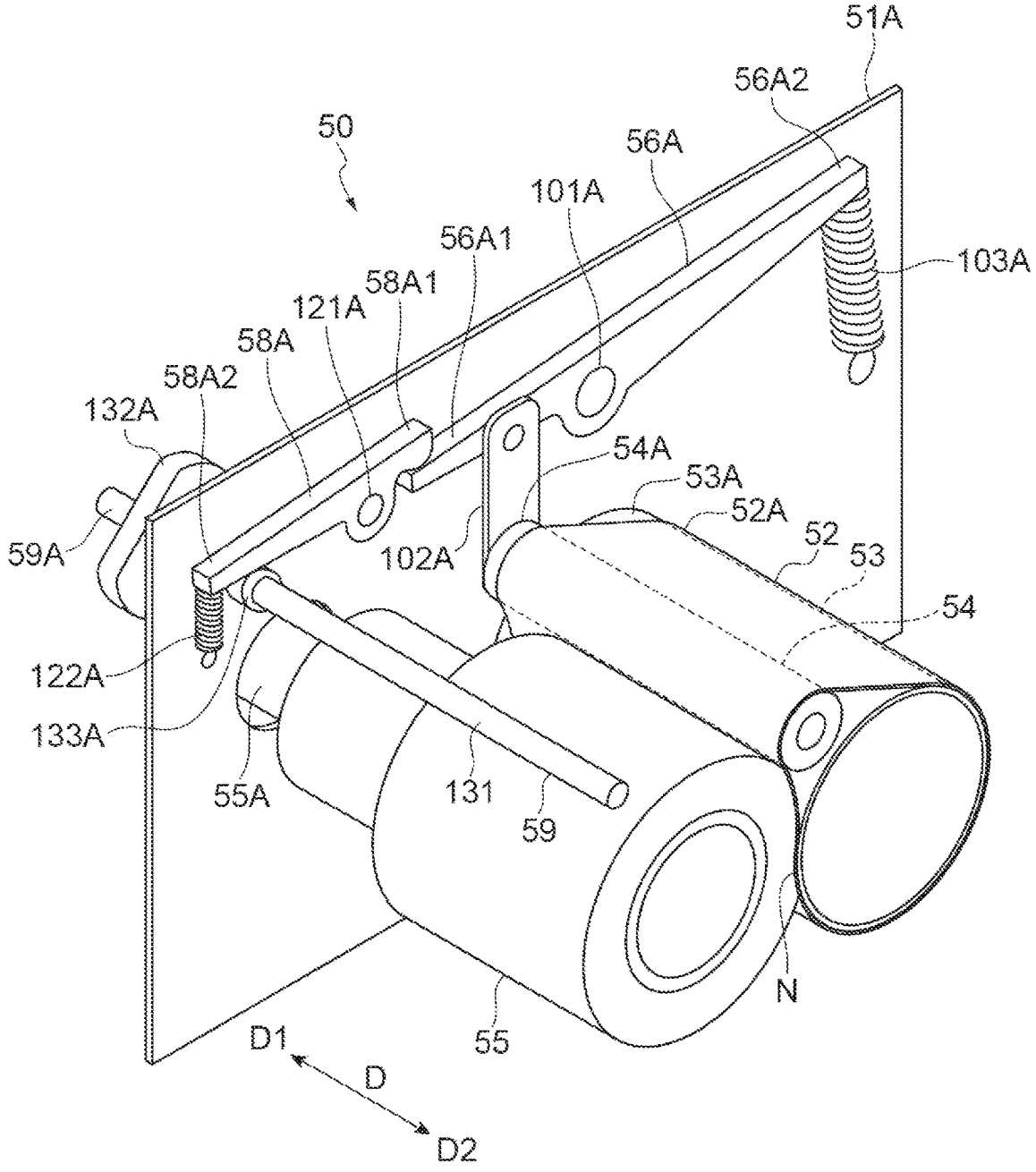
FIG. 2 is a perspective view illustrating a first end of an example fixing device of the image forming apparatus illustrated in FIG. 1.
Figure 3:
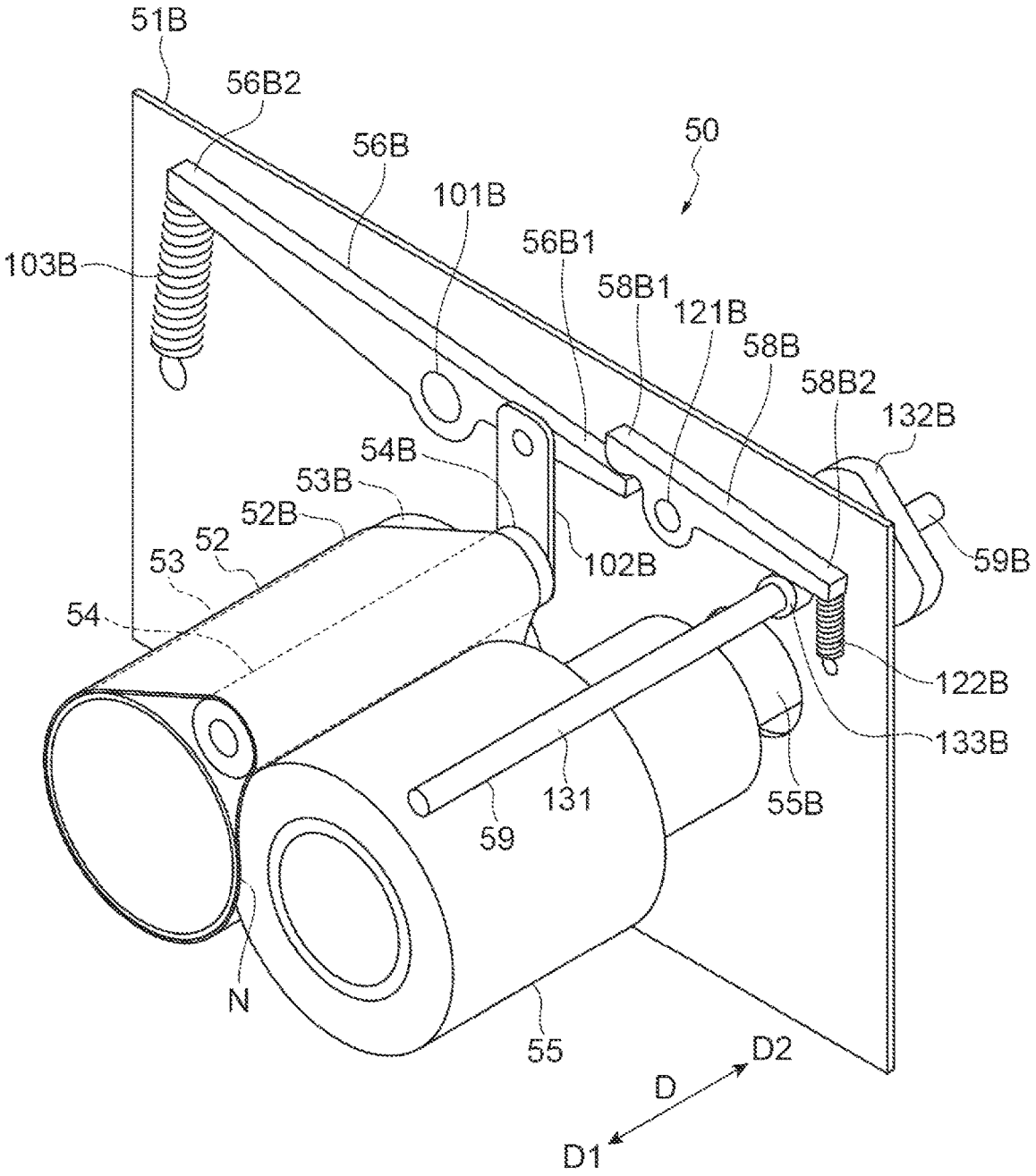
FIG. 3 is a perspective view illustrating a second end of the example fixing device of the image forming apparatus of FIG. 1.

An image forming apparatus according to some examples includes an endless belt to rotate, a nip roller extending adjacent the endless belt to form a nip between the nip roller and the endless belt, belt rollers including a tension roller and an adjustment roller extending inside the endless belt, and a cam shaft. The cam shaft includes a nip forming cam to move the nip roller between a pressed position wherein the nip roller is pressed against the endless belt, and a retracted position wherein the nip roller is retracted from the endless belt. The cam shaft further includes a tension adjustment cam to move the adjustment roller relative to the tension roller.

The image forming apparatus rotates the nip forming cam to move the nip roller between the pressed position and the retracted position, so as to switch between a state where the nip is formed between the endless belt and the nip roller, and a state where the endless belt is spaced away from the nip roller. In addition, the tension of the endless belt can be adjusted by rotating the tension adjustment cam to move the adjustment roller relative to the tension roller. The cam shaft includes the nip forming cam and the tension adjustment cam, so that both the nip forming cam and the tension adjustment cam can be operated by rotating the cam shaft. Accordingly, the size and cost of the image forming apparatus can be reduced while extending the lifespan of the image forming apparatus.

An image forming apparatus according to other examples includes an endless belt to rotate, a nip roller extending adjacent the endless belt to form a nip between the nip roller and the endless belt, belt rollers including a tension roller and an adjustment roller extending in a longitudinal direction inside the endless belt, a nip forming device, and a tension adjustment device. The nip forming device moves the nip roller between a pressed position in which the nip roller is pressed against the endless belt, and a retracted position in which the nip roller is retracted from the endless belt. The tension adjustment device corrects a misalignment of the endless belt in the longitudinal direction when the endless belt rotates by tilting the adjustment roller relative to the tension roller when the nip roller is in the pressed position and when the nip roller is in the retracted position.

The image forming apparatus moves the nip roller between the pressed position and the retracted position, so that the fixing device is capable of switching between a state where the nip is formed between the endless belt and the nip roller, and a state where the endless belt is spaced away from the nip roller. Then, the tension adjustment device tilts the adjustment roller relative to the tension roller regardless of whether the nip roller is in the pressed position or the retracted position, so that a misalignment of the endless belt in the longitudinal direction can be corrected when the endless belt rotates. Accordingly, the lifespan of the image forming apparatus can be extended.

Hereinafter, examples of an image forming apparatus will be described with reference to the drawings. In the following description, with reference to the drawings, the same reference numbers are assigned to the same components or to similar components having the same function, and overlapping description is omitted.

With reference to FIG. 1, an example image forming apparatus 1 forms a color image, using toners of four colors such as magenta, yellow, cyan, and black, which are represented by the characters "M", "Y", "C" and "K", respectively in the reference symbols. The image forming apparatus 1 includes a conveying device 10, a plurality of image carriers 20M, 20Y, 20C, and 20K, a plurality of developing devices 30M, 30Y, 30C, and 30K, a transfer device 40, a fixing device 50, a discharge device 60, and a controller 70.

The conveying device 10 conveys a sheet M (e.g., sheet of paper), which is a recording medium on which an image is to be formed, along a conveyance path 11. The sheets M are stacked and contained in a cassette 12, and are to be picked up from the cassette 12 and conveyed by a sheet feeding roller to the conveyance path 11.

Each of the image carriers 20M, 20Y, 20C, and 20K may also be referred to as an electrostatic latent image carrier, a photoconductor drum, or the like. The image carriers 20M, 20Y, 20C, and 20K form respective electrostatic latent images to generate a magenta toner image, a yellow toner image, a cyan toner image, and a black toner image, respectively. The image carriers 20M, 20Y, 20C, and 20K have substantially the same configuration, and may be collectively referred to herein as the image carrier 20 unless otherwise specified.

The developing devices 30M, 30Y, 30C, and 30K develop the respective electrostatic latent images formed on the surfaces of the respective image carriers 20M, 20Y, 20C, and 20K, to form toner images. The developing devices 30M, 30Y, 30C, and 30K are disposed adjacent the respective image carriers 20M, 20Y, 20C, and 20K to develop the respective electrostatic latent images formed thereon The developing devices 30M, 30Y, 30C, and 30K have substantially the same configuration, and may be collectively referred to herein as the developing devices 30 unless otherwise specified.

The transfer device 40 conveys the respective toner images, which have been developed by the developing devices 30M, 30Y, 30C, and 30K, and transfers the toner images onto the sheet M. The transfer device 40 includes a transfer belt 41, primary transfer rollers 42M, 42Y, 42C, and 42K, and secondary transfer rollers 43 and 44. The primary transfer rollers 42M, 42Y, 42C, and 42K primarily transfer the toner images from the respective image carriers 20M, 20Y, 20C, and 20K onto the transfer belt 41, sequentially and in a layered manner so as to form a single composite toner image on the transfer belt 41. The secondary transfer rollers 43 and 44 secondarily transfer the composite toner image from the transfer belt 41 onto the sheets M.

The fixing device 50 heats and presses the sheet M, onto which the composite toner image has been transferred, to fix the composite toner image onto the sheet M. Examples of the fixing device 50 will be described further below.

The discharge device 60 discharges the sheet M, to which the toner images have been fixed, to the outside of the image forming apparatus 1.

The controller 70 is an electronic control unit including a central processing unit (CPU), a read-only memory (ROM), a random-access memory (RAM), and the like. The controller 70 executes various control operations by loading a program stored in the ROM (e.g., in the form of data and instructions), to the RAM and causing the CPU to execute the program. The controller 70 may include a plurality of electronic control units or may include a single electronic control unit, depending on examples. The controller 70 performs various control operations in the image forming apparatus 1.

FIGS. 2 to 9 illustrate various views of an example fixing device 50 of the image forming apparatus 1 illustrated in FIG. 1. With reference to FIGS. 2 to 9, the example fixing device 50 includes a first frame 51A, a second frame 51B, an endless belt 52, a tension roller 53, an adjustment roller 54, a nip roller 55, a first tension applying lever 56A, a second tension applying lever 56B, a first nip forming lever 57A, a second nip forming lever 57B, a first tension adjustment lever 58A, a second tension adjustment lever 58B, and a cam shaft 59.

The first frame 51A and the second frame 51B are members that support the tension roller 53, the adjustment roller 54, the nip roller 55, the first tension applying lever 56A, the second tension applying lever 56B, the first nip forming lever 57A, the second nip forming lever 57B, the first tension adjustment lever 58A, the second tension adjustment lever 58B, and the cam shaft 59. The first frame 51A and the second frame 51B are disposed to face each other in a longitudinal direction or orientation D. The longitudinal direction or longitudinal orientation D defines a first direction (first longitudinal direction) D1, and a second direction (second longitudinal direction) D2 that is opposite the first longitudinal direction D1. In the present disclosure, a region between the first frame 51A and the second frame 51B may be referred to as an inside (or inner region) of the fixing device 50, a location of the inner region adjacent the first frame 51A may be referred to as an inner side of the first frame 51A, and a location of the inner region adjacent the second frame 51B may be referred to as an inner side of the second frame 51B. In addition, a region adjacent the first frame 51A on a side opposite the second frame 51B may be referred to as an outer side of the first frame 51A, and a region adjacent the second frame 51B on a side opposite the first frame 51A may be referred to as an outer side of the second frame 51B.

The endless belt 52 is an endless belt suspended by the tension roller 53 and the adjustment roller 54. The endless belt 52 is disposed between the first frame 51A and the second frame 51B. The endless belt 52 forms a nip N between the endless belt 52 and the nip roller 55 to fix the toner images to the sheet M. Accordingly, the endless belt 52 is also referred to herein as a fixing belt. The tension roller 53 and the adjustment roller 54 are belt rollers extending inside the endless belt 52. The belt rollers extending inside the endless belt 52 may include rollers other than the tension roller 53 and the adjustment roller 54. The endless belt 52 is suspended by the tension roller 53 and the adjustment roller 54, which are the belt rollers, to extend in the longitudinal orientation D. The endless belt 52 includes a first end (or first edge) 52A and a second end (or second edge) 52B opposite the first end 52A in the longitudinal orientation D. The first end 52A is an end of the endless belt 52 toward the first longitudinal direction D1, and the second end 52B is an end of the endless belt 52 toward the second longitudinal direction D2.

The tension roller 53 extends in the longitudinal orientation D, and is rotatable about a rotation axis A53 of the tension roller 53. The tension roller 53 is, for example, a drive roller to be rotationally driven by a drive device such as a motor. The tension roller 53 includes a first end 53A and a second end 53B opposite the first end 53A in a longitudinal direction of the tension roller 53 that extends in the longitudinal orientation D. The first end 53A is an end of the tension roller 53 that extends toward the first longitudinal direction D1. In addition, the second end 53B is an end of the tension roller 53 that extends toward the second longitudinal direction D2. The first end 53A extends through the first frame 51A to the outer side of the first frame 51A. Similarly, the second end 53B extends through the second frame 51B to the outer side of the second frame 51B. Accordingly, the tension roller 53 is rotatably supported by the first frame 51A and the second frame 51B such that the rotation axis A53 extends in the longitudinal orientation D. Namely, the first end 53A of the tension roller 53 is rotatably supported by the first frame 51A, and the second end 53B of the tension roller 53 is rotatably supported by the second frame 51B.

The adjustment roller 54 extends adjacent the tension roller 53, and is rotatable about a rotation axis A54 of the adjustment roller 54. The adjustment roller 54 is, for example, a driven roller. The adjustment roller 54 is supported to be movable toward and away from the tension roller 53. When the adjustment roller 54 moves away from the tension roller 53, the tension of the endless belt 52 increases. On the other hand, when the adjustment roller 54 moves toward the tension roller 53, the tension of the endless belt 52 decreases. Namely, the adjustment roller 54 moves toward and away from the tension roller 53 to change the tension of the endless belt 52. The direction toward and away from the tension roller 53 may refer to any suitable direction, including not only a radial direction relative to the rotation axis A53 of the tension roller 53, but also other directions or trajectory along which the adjustment roller 54 may move away from or toward the tension roller 53.

The adjustment roller 54 includes a first end 54A and a second end 54B opposite the first end 54A in a longitudinal direction of the adjustment roller 54 that extends in the longitudinal orientation D. The first end 54A is an end of the adjustment roller 54 toward the first direction D1, and the second end 54B is an end of the adjustment roller 54 toward the second direction D2. The adjustment roller 54 is rotatably supported by the first tension applying lever 56A and the second tension applying lever 56B, which are pivotally supported on the first frame 51A and the second frame 51B, respectively. Namely, the first end 54A of the adjustment roller 54 is rotatably supported by the first tension applying lever 56A on an inner side of the first frame 51A, and the first tension applying lever 56A is pivotally supported by the first frame 51A. In addition, the second end 54B of the adjustment roller 54 is rotatably supported by the second tension applying lever 56B on an inner side of the second frame 51B, and the second tension applying lever 56B is pivotally supported by the second frame 51B.

Accordingly, the adjustment roller 54 is supported by the first tension applying lever 56A, the second tension applying lever 56B, the first frame 51A, and the second frame 51B so as to be rotatable about the rotation axis A54 and is movable toward and away from the tension roller 53. The first tension applying lever 56A and the second tension applying lever 56B are described further below.

The nip roller 55 extends adjacent the endless belt 52 to form the nip N between the nip roller 55 and the endless belt 52. The nip roller 55 extends in the longitudinal orientation D, and is rotatable about a rotation axis A55 of the nip roller 55. The nip roller 55 is, for example, a driven roller. The nip roller 55 is supported to be movable toward and away from the endless belt 52. The direction toward and away from the endless belt 52 includes any relevant directions, including not only a normal direction to the endless belt 52 but also other directions in which the nip roller 55 may move away from or toward the endless belt 52.

Figure 4:
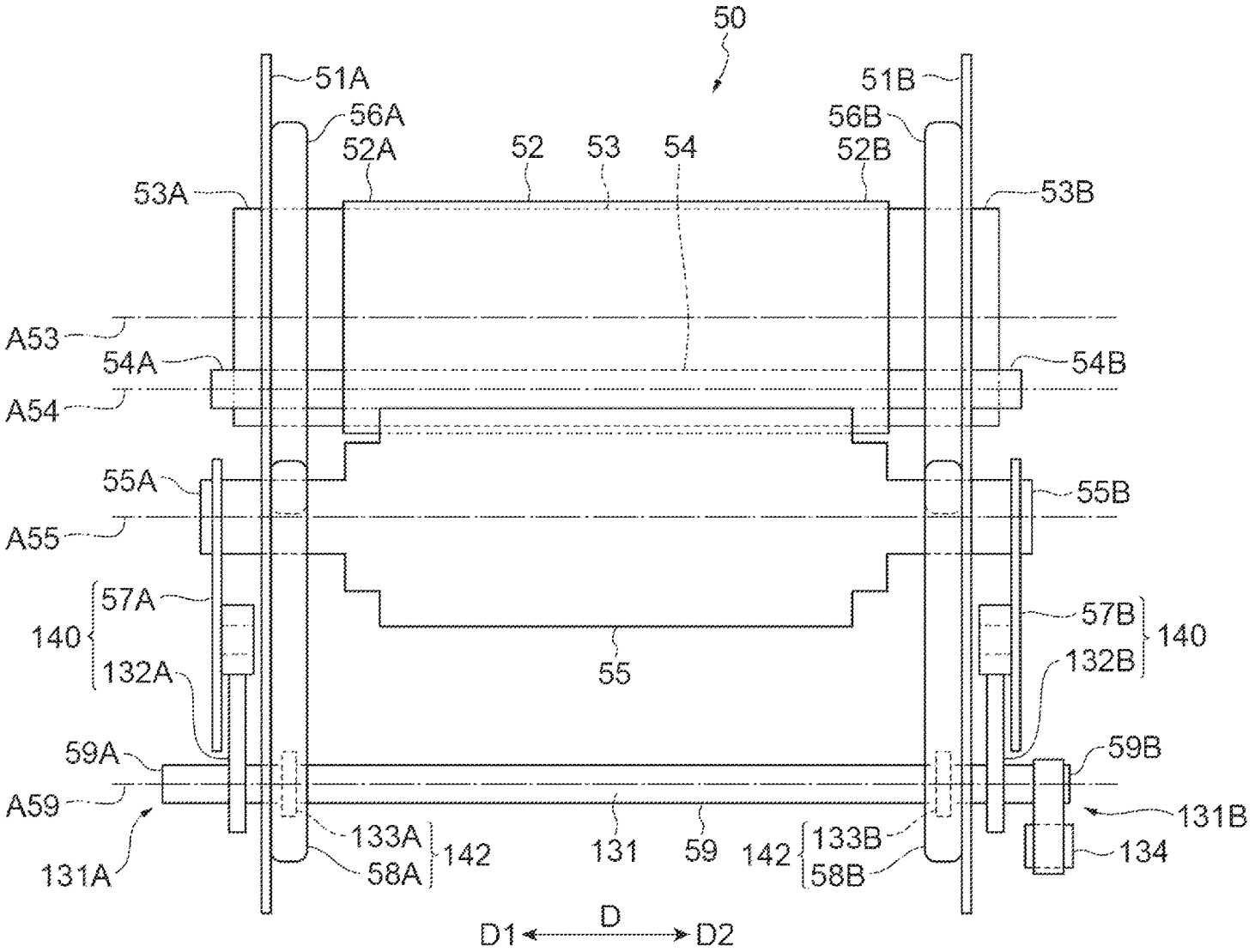
FIG. 4 is a schematic top plan view of the example fixing device illustrated in a state where a nip roller is in a pressed position.
Figure 5:
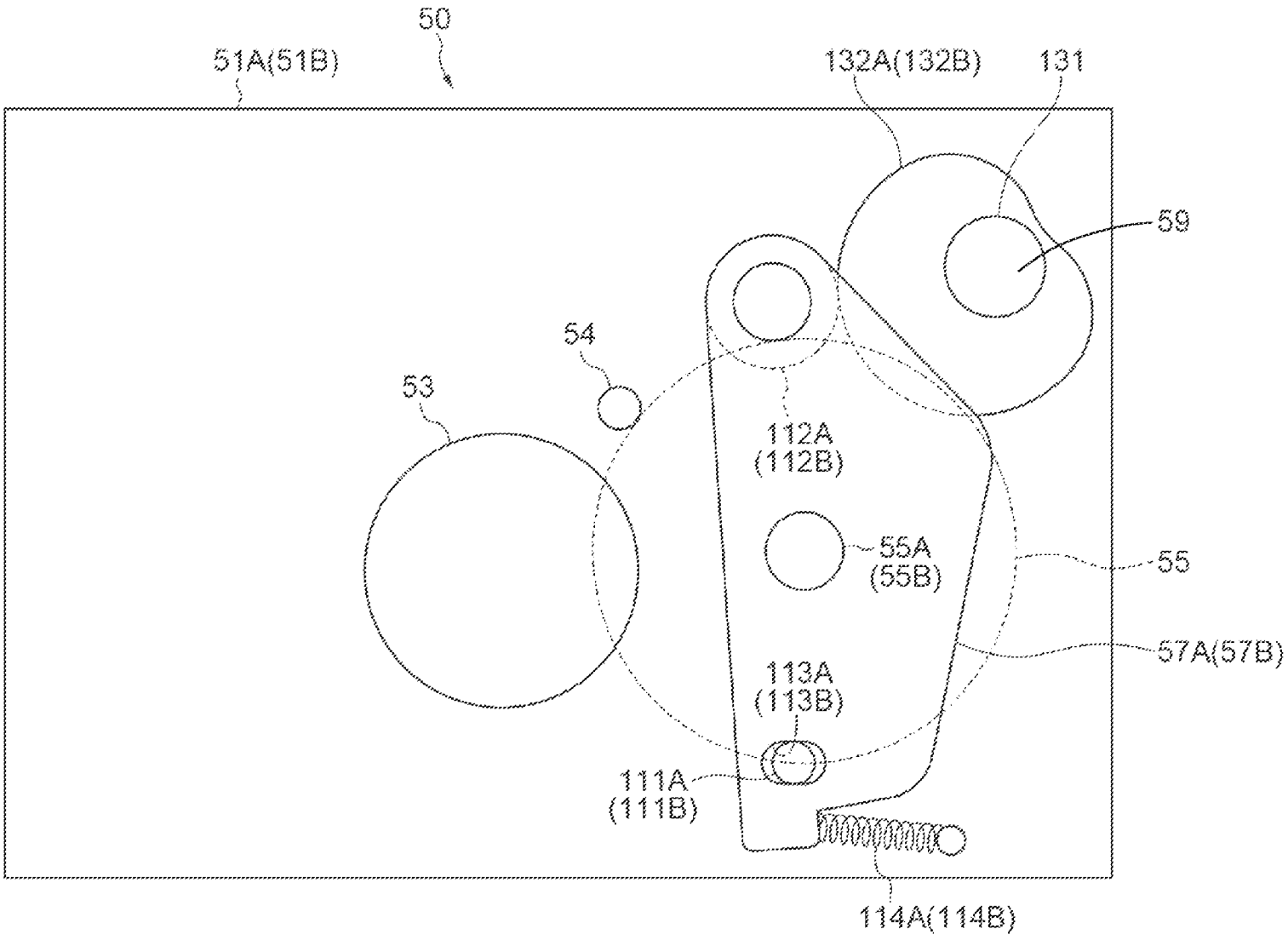
FIG. 5 is a schematic side view illustrating components on an outer side of a frame of the example fixing device, illustrated in a state where the nip roller is in the pressed position.
Figure 6:
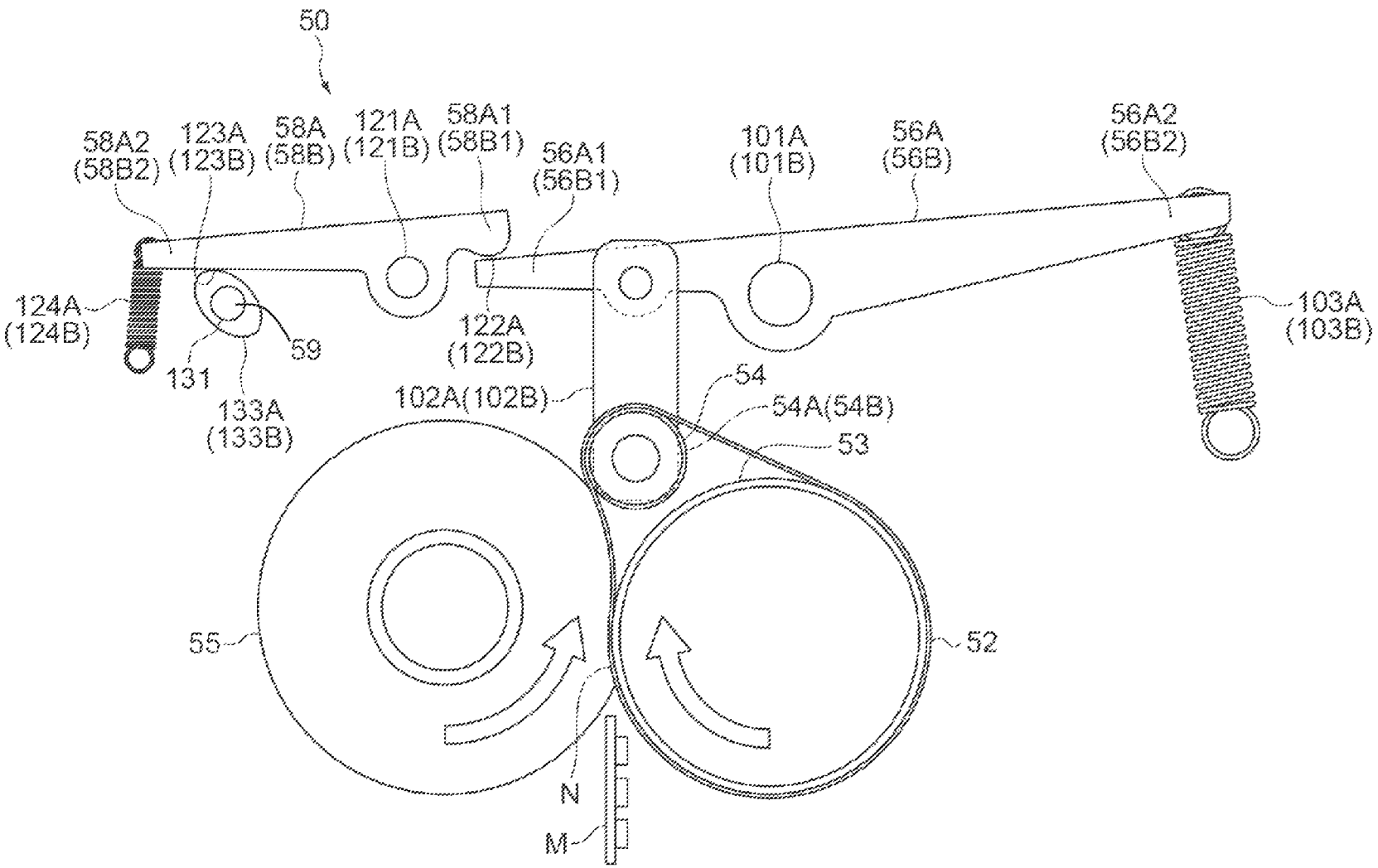
FIG. 6 is a schematic side view illustrating components on an inner side of the frame of the example fixing device, illustrated in a state where the nip roller is in the pressed position.

With reference to FIGS. 4 to 6, when the nip roller 55 moves toward the endless belt 52, the nip roller 55 presses the endless belt 52 to form the nip N between the nip roller 55 and the endless belt 52. The position of the nip roller 55 in this state is referred to as a pressed position. Namely, the pressed position is a position in which the nip roller 55 is pressed against the endless belt 52 to form the nip N between the nip roller 55 and the endless belt 52. The pressed position may be a position in which the nip roller 55 presses the endless belt 52 against the tension roller 53 and the adjustment roller 54, or may be a position in which the nip roller 55 applies a pressure against the endless belt 52 that is equal to or greater than a threshold pressure.

Figure 7:
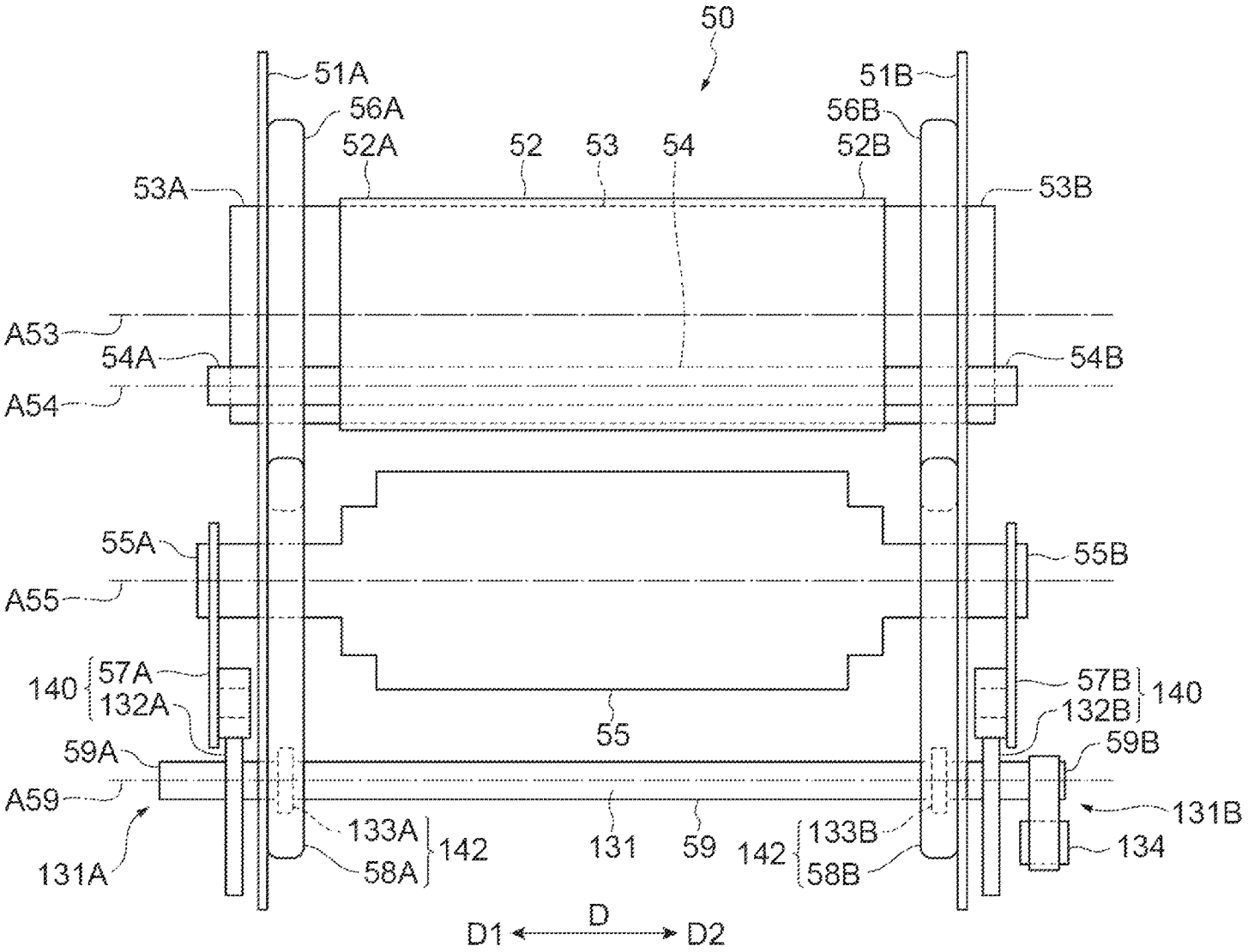
FIG. 7 is a schematic top plan view of the example fixing device in a state where the nip roller is in a retracted position.
Figure 8:
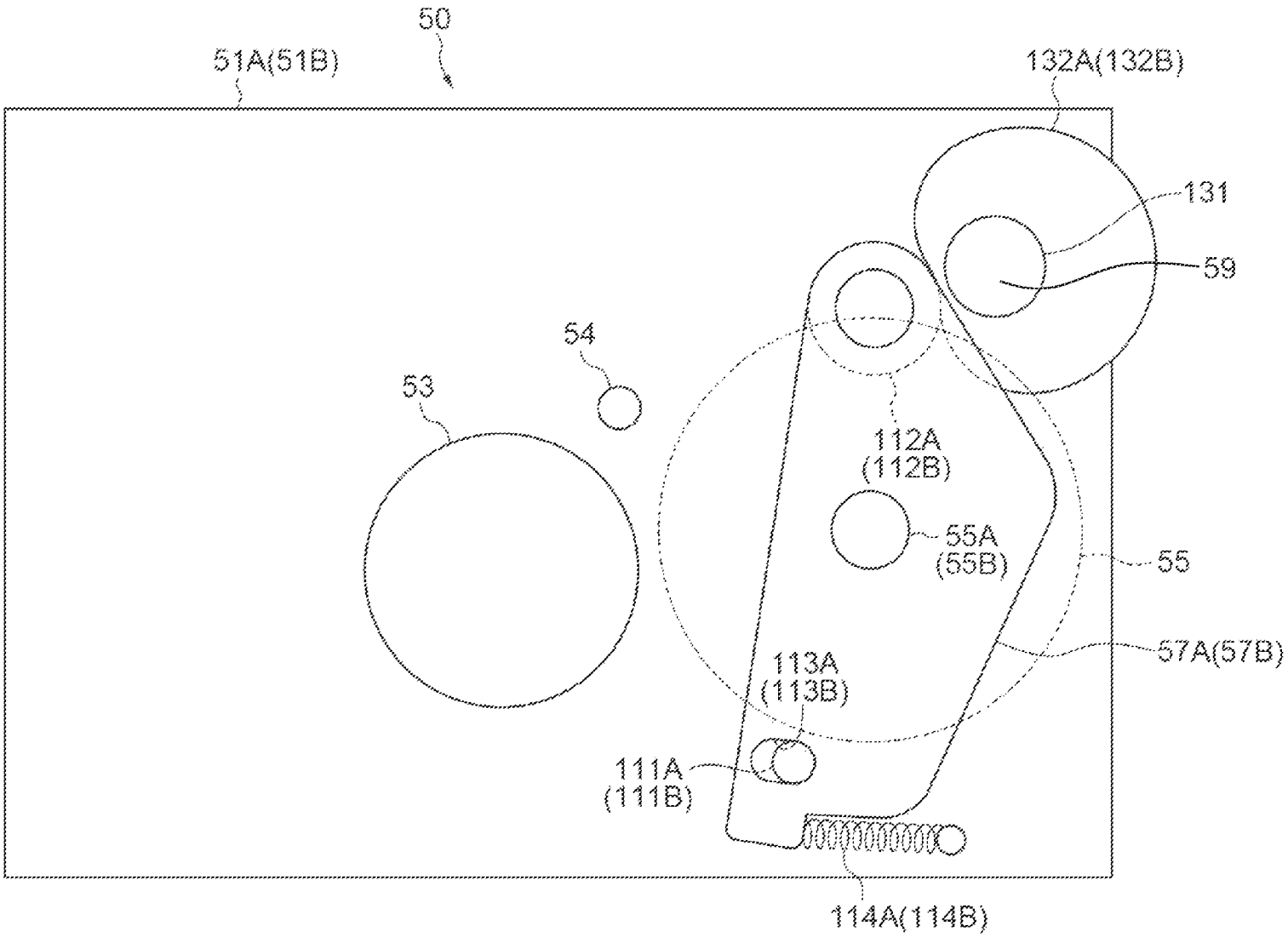
FIG. 8 is a schematic side view illustrating the components on the outer side of the frame of the example fixing device, illustrated in a state where the nip roller is in the retracted position.
Figure 9:
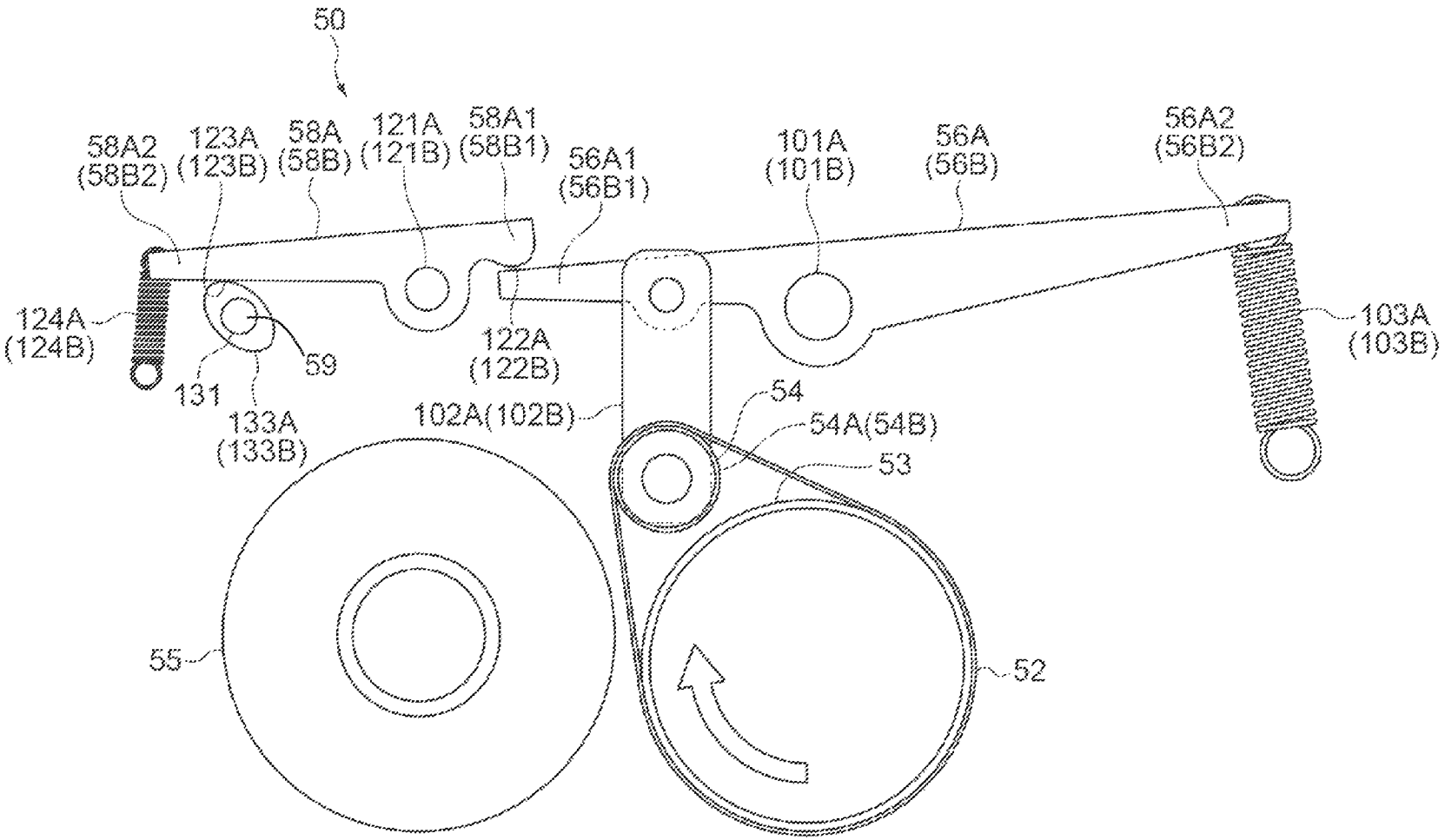
FIG. 9 is a schematic side view illustrating the components on the inner side of the frame of the example fixing device, illustrated in a state where the nip roller is in the retracted position.

With reference to FIGS. 7 to 9, when the nip roller 55 moves away from the endless belt 52, the nip roller 55 retracts from the endless belt 52 so as not to form the nip N between the nip roller 55 and the endless belt 52. The position of the nip roller 55 in this state is referred to as a retracted position. Namely, the retracted position is a position in which the nip roller 55 is retracted from the endless belt 52 so that the nip roller 55 is spaced away from the endless belt 52. Accordingly, the retracted position is a position of the nip roller 55 in which the nip N is not formed between the nip roller 55 and the endless belt 52.

The nip roller 55 includes a first end 55A and a second end 55B opposite the first end 55A in a longitudinal direction of the nip roller 55 that extends in the longitudinal orientation D of the nip roller 55. The first end 55A is an end of the nip roller 55 toward the first longitudinal direction D1, and the second end 55B is an end of the nip roller 55 toward the second direction D2. The first end 55A extends through the first frame 51A to the outer side of the first frame 51A, and the second end 55B extends through the second frame 51B to the outer side of the second frame 51B. The nip roller 55 is rotatably supported by the first nip forming lever 57A and the second nip forming lever 57B, and the first nip forming lever 57A and the second nip forming lever 57B are pivotally supported (pivoted) by the first frame 51A and the second frame 51B. Namely, the first end 55A of the nip roller 55 is rotatably supported by the first nip forming lever 57A at the outer side of the first frame 51A, and the first nip forming lever 57A is pivotally supported by the first frame 51A. In addition, the second end 55B of the nip roller 55 is rotatably supported by the second nip forming lever 57B at the outer side of the second frame 51B, and the second nip forming lever 57B is pivotally supported by the second frame 51B. Accordingly, the nip roller 55 is supported by the first nip forming lever 57A, the second nip forming lever 57B, the first frame 51A, and the second frame 51B so as to be movable toward and away from the endless belt 52 while maintaining a state where the rotation axis A55 extends in the longitudinal orientation D. Details of the first nip forming lever 57A and the second nip forming lever 57B will be described later.

One roller among the tension roller 53 and the nip roller 55 is a heating roller that heats the sheet M supplied to the nip. The other of the tension roller 53 and the nip roller 55 is a pressure roller that presses the endless belt 52 against the heating roller. For example, a heating device such as a halogen lamp is built in the heating roller. The pressure roller includes, for example, an elastically deformable outer peripheral portion. In some examples, both the adjustment roller 54 and the nip roller 55 may be heating rollers. In this example, as one example, the tension roller 53 is a heating roller, the nip roller 55 is a pressure roller, and the nip roller 55 includes an elastically deformable outer peripheral portion.

The first tension applying lever 56A and the second tension applying lever 56B move the adjustment roller 54 relative to the tension roller 53.

The first tension applying lever 56A is disposed on the inner side of the first frame 51A. The first tension applying lever 56A extends along the first frame 51A in a direction orthogonal to the longitudinal orientation D. The first tension applying lever 56A includes a first end 56A1 in an extending direction of the first tension applying lever 56A, and a second end 56A2 opposite the first end 56A1 in the extending direction of the first tension applying lever 56A. The first tension applying lever 56A is pivotally supported (pivotable) on the first frame 51A by a shaft 101A. The shaft 101A is disposed between the first end 56A1 and the second end 56A2. The first end 56A1 of the first tension applying lever 56A is coupled with the first end 54A of the adjustment roller 54 via a coupling member 102A. The coupling member 102A is rotatably coupled with the first end 56A1 of the first tension applying lever 56A, and is coupled with the first end 54A of the adjustment roller 54. The coupling member 102A extends, for example, linearly from the first end 56A1 of the first tension applying lever 56A to the first end 54A of the adjustment roller 54. The second end 56A2 of the first tension applying lever 56A is coupled with a first biasing member 103A. The first biasing member 103A biases the second end 56A2 of the first tension applying lever 56A to urge the first end 54A of the adjustment roller 54 away from the first end 53A of the tension roller 53. For example, the first biasing member 103A biases the first end 56A1 of the first tension applying lever 56A to urge the first end 56A1 of the first tension applying lever 56A opposite the first end 53A of the tension roller 53. The first biasing member 103A is, for example, a coil spring.

Similarly, the second tension applying lever 56B is disposed on the inner side of the second frame 51B. The second tension applying lever 56B extends along the second frame 51B in the direction orthogonal to the longitudinal orientation D. The second tension applying lever 56B includes a first end 56B1 in an extending direction of the second tension applying lever 56B, and a second end 5682 opposite the first end 5681 in the extending direction of the second tension applying lever 56B. The second tension applying lever 56B is pivotally supported (pivotable) on the second frame 51B by a shaft 101B. The shaft 101B is disposed between the first end 5681 and the second end 5682. The first end 5681 of the second tension applying lever 56B is coupled with the second end 54B of the adjustment roller 54 via a coupling member 102B. The coupling member 1028 is rotatably coupled with the second end 5682 of the second tension applying lever 568, and is rotatably coupled with the second end 54B of the adjustment roller 54. The coupling member 102B extends, for example, linearly from the first end 5681 of the second tension applying lever 56B to the second end 54B of the adjustment roller 54. The second end 5682 of the second tension applying lever 56B is coupled with a second biasing member 103B. The second biasing member 103B biases the second end 5682 of the second tension applying lever 56B to urge the second end 54B of the adjustment roller 54 away from the second end 53B of the tension roller 53. For example, the second biasing member 103B biases the second tension applying lever 56B to urge the first end 5681 of the second tension applying lever 56B opposite the second end 53B of the tension roller 53. The second biasing member 1038 is, for example, a coil spring.

The first nip forming lever 57A and the second nip forming lever 57B rotatably support the nip roller 55 such that the nip roller 55 is movable toward and away from the endless belt 52.

The first nip forming lever 57A is disposed on the outer side of the first frame 51A. The first nip forming lever 57A extends along the first frame 51A in the direction orthogonal to the longitudinal orientation D. The first nip forming lever 57A is pivotally and slidably supported (pivotable) on the first frame 51A by a shaft or pin 111A. The first nip forming lever 57A rotatably supports a roller 112A. The roller 112A is a rotatable contact member that contacts a first nip forming cam 132A of the cam shaft 59. A rotation axis of the roller 112A extends in the longitudinal orientation D. The first nip forming lever 57A has a slot 113A into which the pin 111A is inserted and which is slidable relative to the pin 111A. The slot 113A extends in a direction orthogonal to the pin 111A such that the first end 55A of the nip roller 55 is movable toward and away from the endless belt 52. Consequently, when the pin 111A is guided by the slot 113A, the first nip forming lever 57A is slidable within a range of the length of the slot 113A to move the first end 55A of the nip roller 55 toward and away from the endless belt 52. The first nip forming lever 57A is coupled with a first biasing member 114A. The first biasing member 114A biases the first nip forming lever 57A to urge the first end 55A of the nip roller 55 toward the endless belt 52. The first biasing member 114A is coupled with, for example, a side (or position) of the first nip forming lever 57A, which is located opposite the roller 112A relative to the pin 111A. The first biasing member 114A is, for example, a coil spring.

The first nip forming lever 57A rotatably supports the first end 55A of the nip roller 55 such that the first end 55A of the nip roller 55 is movable toward and away from the endless belt 52 when the first nip forming lever 57A pivots about the pin 111A. Namely, when the roller 112A pivots about the pin 111A away from a rotation axis A59 of the cam shaft 59, the first nip forming lever 57A moves the first end 55A of the nip roller 55 toward the endless belt 52. On the other hand, when the roller 112A pivots about the pin 111A toward the rotation axis A59 of the cam shaft 59, the first nip forming lever 57A moves the first end 55A of the nip roller 55 away from the endless belt 52. In addition, the slot 113A slides relative to the pin 111A, so that the first nip forming lever 57A is capable of moving the position of the first end 55A of the nip roller 55 in a direction in which the nip roller 55 moves toward and away from the endless belt 52. The first end 55A of the nip roller 55 is disposed, for example, between the pin 111A and the roller 112A. In addition, the first nip forming cam 132A of the cam shaft 59 and the first end 55A of the nip roller 55 are disposed opposite a plane connecting a rotation axis of the pin 111A and the rotation axis of the roller 112A.

Similarly, the second nip forming lever 57B is disposed on the outer side of the second frame 51B. The second nip forming lever 57B extends along the second frame 51B in the direction orthogonal to the longitudinal orientation D. The second nip forming lever 57B is pivotally supported (pivoted) on the second frame 51B by a shaft or pin 111B. The second nip forming lever 57B rotatably supports a roller 112B. The roller 112B is a rotatable contact member that contacts a second nip forming cam 132B of the cam shaft 59. A rotation axis of the roller 112B extends in the longitudinal orientation D. The second nip forming lever 57B has a slot 113B into which the pin 111B is inserted and which is slidable relative to the pin 111B. The slot 113B extends in a direction orthogonal to the pin 111B such that the second end 55B of the nip roller 55 is movable toward and away from the endless belt 52. Consequently, when the pin 111B is guided by the slot 1138, the second nip forming lever 57B is slidable within a range of the length of the slot 1138 to move the second end 55B of the nip roller 55 toward and away from the endless belt 52. The second nip forming lever 57B is coupled with a second biasing member 114B. The second biasing member 1148 biases the second nip forming lever 57B to urge the second end 55B of the nip roller 55 toward the endless belt 52. The second biasing member 114B is coupled with, for example, a side (or position) of the second nip forming lever 57B, which is located opposite the roller 112B relative to the pin 111B. The second biasing member 114B is, for example, a coil spring.

Accordingly, the second nip forming lever 57B rotatably supports the second end 55B of the nip roller 55 such that the second end 55B of the nip roller 55 is movable toward and away from the endless belt 52 when the second nip forming lever 57B pivots about the pin 111B. Namely, when the roller 112B pivots about the pin 111B away from the rotation axis A59 of the cam shaft 59, the second nip forming lever 57B moves the second end 55B of the nip roller 55 toward the endless belt 52. On the other hand, when the roller 112B pivots about the pin 111B toward the rotation axis A59 of the cam shaft 59, the second nip forming lever 57B moves the second end 55B of the nip roller 55 away from the endless belt 52. In addition, the slot 113B slides relative to the pin 111B, so that the second nip forming lever 57B is capable of moving the position of the second end 55B of the nip roller 55 in the direction in which the nip roller 55 moves toward and away from the endless belt 52. The second end 55B of the nip roller 55 is disposed, for example, between the pin 111B and the roller 112B. In addition, the second nip forming cam 132B of the cam shaft 59 and the second end 55B of the nip roller 55 are disposed opposite a plane connecting a rotation axis of the pin 111B and the rotation axis of the roller 112B.

Figure 10:
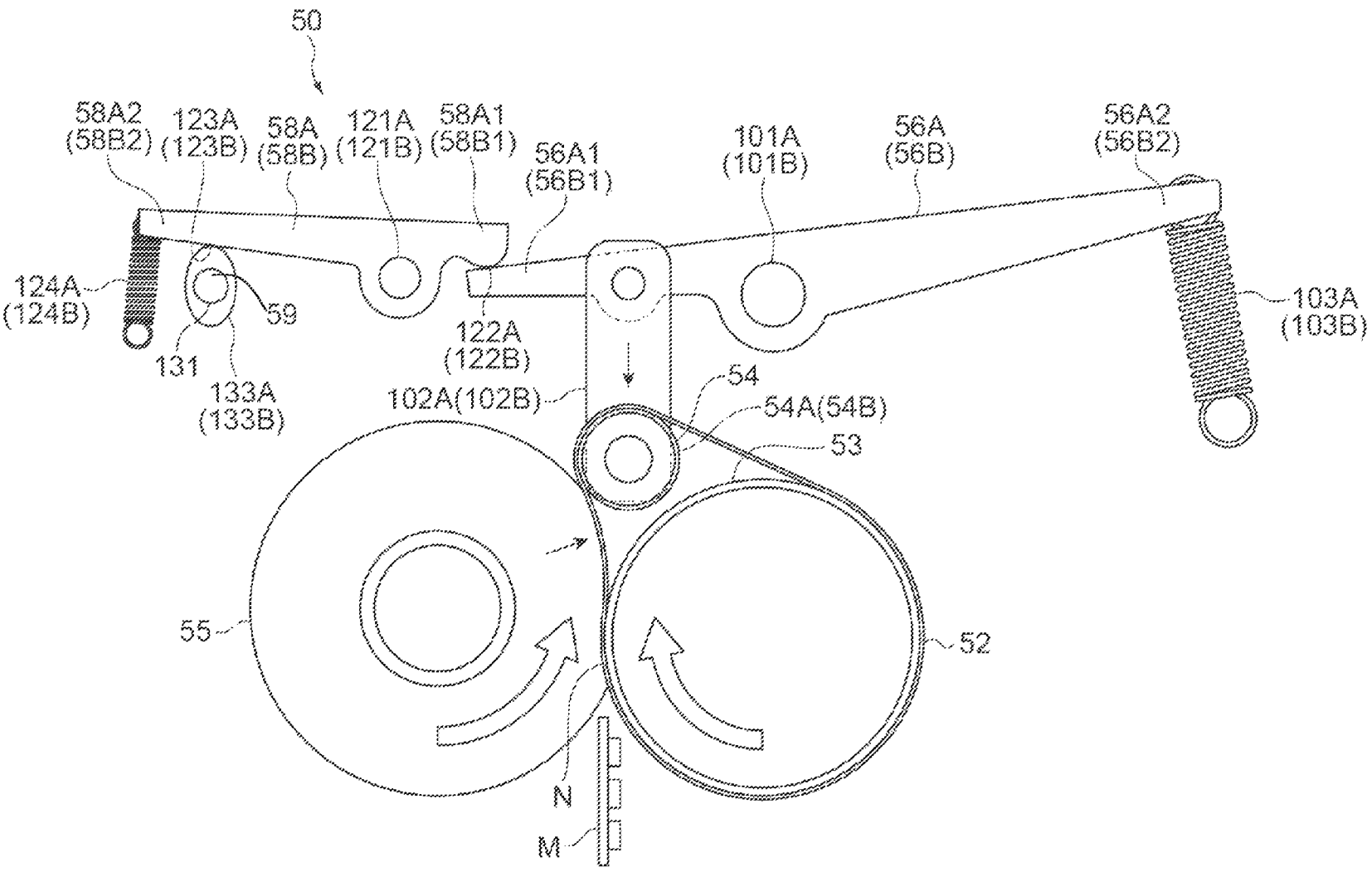
FIG. 10 is a schematic side view illustrating the components on the inner side of the frame of the example fixing device, illustrated in a state where the tension of an endless belt is adjusted when the nip roller is in the pressed position.
Figure 11:
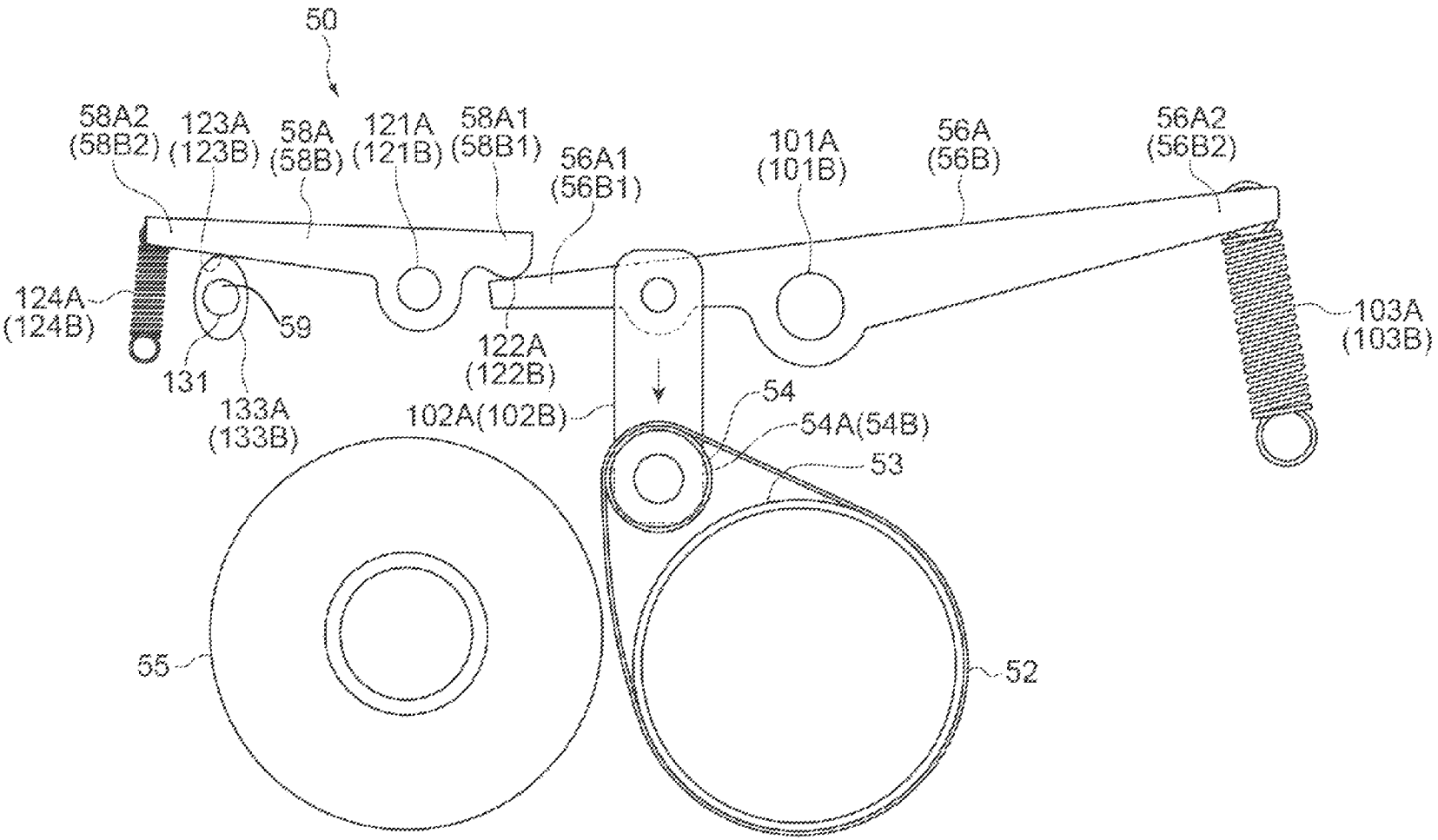
FIG. 11 is a schematic side view illustrating the components on the inner side of the frame of the example fixing device, illustrated in a state where the tension of the endless belt is adjusted when the nip roller is in the retracted position.

FIGS. 10 and 11 illustrate components on an inner side of the frame of the example fixing device 50, in a pressed position of the nip roller 55 and in a retracted position of the nip roller 55, respectively. With reference to FIGS. 2 to 11, the first tension adjustment lever 58A and the second tension adjustment lever 58B contact the first tension applying lever 56A and the second tension applying lever 56B, respectively, to move the adjustment roller 54 relative to the tension roller 53.

The first tension adjustment lever 58A is disposed on the inner side of the first frame 51A. The first tension adjustment lever 58A extends along the first frame 51A in the direction orthogonal to the longitudinal orientation D. The first tension adjustment lever 58A includes a first end 58A1 in an extending direction of the first tension adjustment lever 58A, and a second end 58A2 opposite the first end 58A1 in the extending direction of the first tension adjustment lever 58A. The first tension adjustment lever 58A is pivotally supported (pivotable) on the first frame 51A by a shaft 121A. The shaft 121A is disposed between the first end 58A1 and the second end 58A2.

The first end 58A1 of the first tension adjustment lever 58A has a pressing surface 122A that contacts the first end 56A1 of the first tension applying lever 56A. The pressing surface 122A contacts a surface at the first end 56A1 of the first tension applying lever 56A, the surface being opposite the adjustment roller 54. Consequently, when the first tension adjustment lever 58A pivots about the shaft 121A, the pressing surface 122A is capable of moving the first end 56A1 of the first tension applying lever 56A toward the adjustment roller 54, so as to move the first end 54A of the adjustment roller 54 toward the tension roller 53. The second end 58A2 of the first tension adjustment lever 58A has a contact surface 123A that a first tension adjustment cam 133A of the cam shaft 59 contacts. The first tension adjustment cam 133A of the cam shaft 59 contacts the contact surface 123A to restrict the first tension adjustment lever 58A from pivoting about the shaft 121A. The contact surface 123A may be located, for example, on a surface of the first tension adjustment lever 58A, that is oriented in an opposite direction from the pressing surface 122A in a pivoting direction of the first tension adjustment lever 58A about the shaft 121A. Namely, the contact surface 123A is positioned to receive a force that moves the first tension adjustment lever 58A in a first rotational direction about the shaft 121A, and the pressing surface 122A is positioned to receive a force that moves the first tension adjustment lever 58A in a second rotational direction about the shaft 121A, that is opposite to the first rotational direction. The second end 58A2 of the first tension adjustment lever 58A is coupled with a first biasing member 124A. The first biasing member 124A biases the second end 58A2 of the first tension adjustment lever 58A to urge the second end 58A2 of the first tension adjustment lever 58A toward the first tension adjustment cam 133A of the cam shaft 59. The first biasing member 124A is, for example, a coil spring.

Similarly, the second tension adjustment lever 58B is disposed on the inner side of the second frame 51B. The second tension adjustment lever 58B extends along the second frame 51B in the direction orthogonal to the longitudinal orientation D. The second tension adjustment lever 58B includes a first end 58B1 in an extending direction of the second tension adjustment lever 58B, and a second end 58B2 opposite the first end 58B1 in the extending direction of the second tension adjustment lever 58B. The second tension adjustment lever 58B is pivotally supported (pivoted) on the second frame 51B by a shaft 121B. The shaft 121B is disposed between the first end 58B1 and the second end 58B2.

The first end 58B1 of the second tension adjustment lever 58B has a pressing surface 122B that contacts the first end 56B1 of the second tension applying lever 56B. The pressing surface 122B contacts a surface at the first end 56B1 of the second tension applying lever 56B, the surface being opposite the adjustment roller 54. Consequently, when the second tension adjustment lever 58B pivots about the shaft 121B, the pressing surface 122B is capable of moving the first end 56B1 of the second tension applying lever 56B toward the adjustment roller 54, so as to move the second end 54B of the adjustment roller 54 toward the tension roller 53. The second end 58B2 of the second tension adjustment lever 58B has a contact surface 123B that a second tension adjustment cam 133B of the cam shaft 59 contacts. The second tension adjustment cam 133B of the cam shaft 59 contacts the contact surface 123B to restrict the second tension adjustment lever 58B from pivoting about the shaft 121B. The contact surface 123B may be located, for example, on a surface of the second tension adjustment lever 588, that is oriented in an opposite direction from the pressing surface 122B in a pivoting direction of the second tension adjustment lever 58B about the shaft 121B. Namely, the contact surface 123B is positioned to receive a force that moves the second tension adjustment lever 58B in a first rotational direction about the shaft 121B, and the pressing surface 1228 is positioned to receive a force that moves the second tension adjustment lever 58B in a second rotational direction about the shaft 121B, that is opposite to the first rotational direction. The second end 5882 of the second tension adjustment lever 58B is coupled with a second biasing member 124B. The second biasing member 1248 biases the second end 5882 of the second tension adjustment lever 58B to urge the second end 5882 of the second tension adjustment lever 58B toward the second tension adjustment cam 133B of the cam shaft 59. The second biasing member 1248 is, for example, a coil spring.

Figure 12:
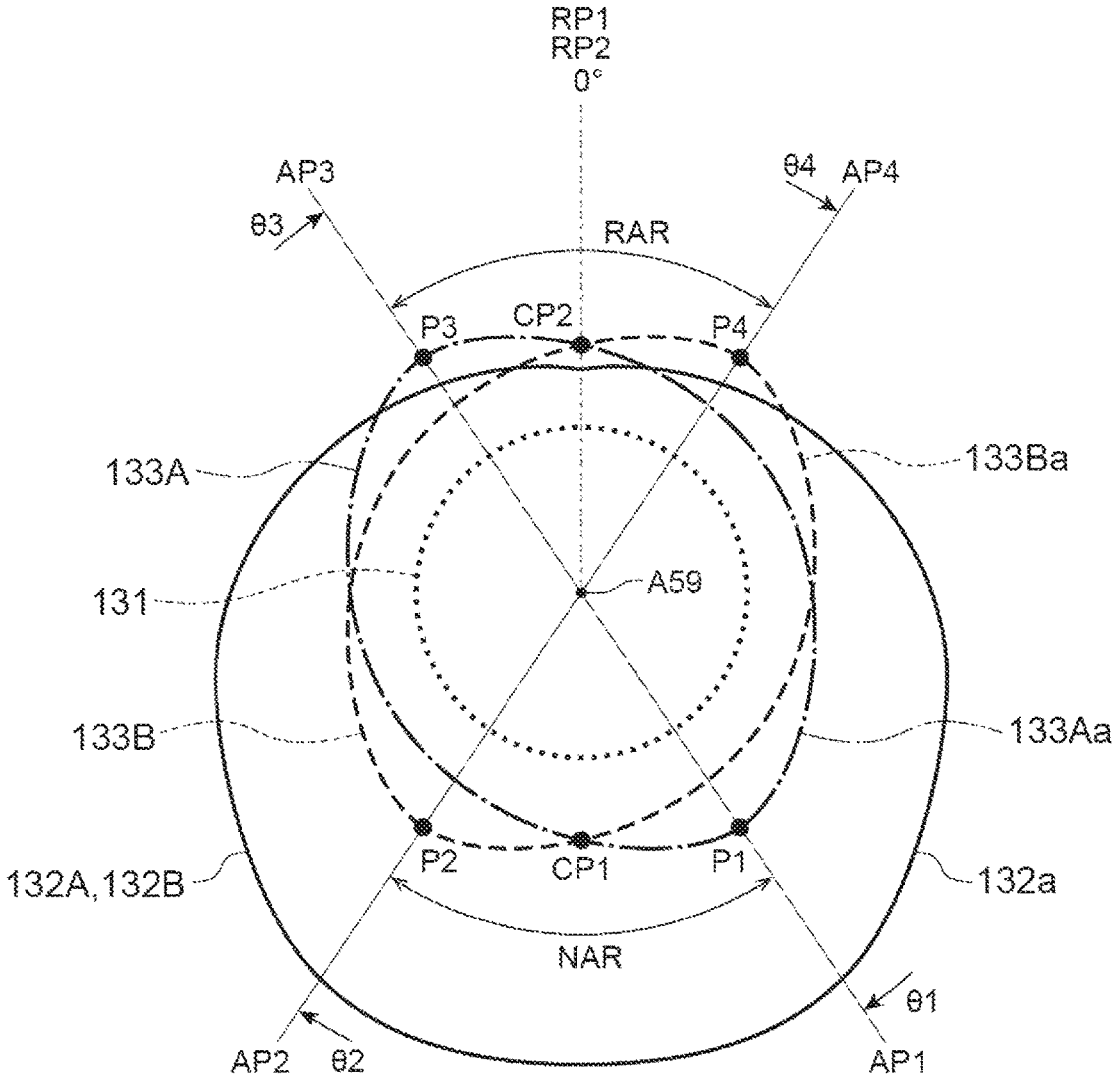
FIG. 12 is a schematic diagram illustrating the shapes of cams of the fixing device, relative positions of the cams on a cam shaft.

FIG. 12 illustrates a relationship between the cams on the cam shaft. With reference to FIGS. 2 to 12, the cam shaft 59 includes a shaft portion 131, the first nip forming cam 132A, the second nip forming cam 1328, the first tension adjustment cam 133A, and the second tension adjustment cam 133B. The first nip forming cam 132A, the first tension adjustment cam 133A, the second tension adjustment cam 1338, and the second nip forming cam 1328 are arranged along the cam shaft 59 in the longitudinal orientation D. The cam shaft 59 includes a first reference position RP1 representing a zero-degree angular position of the first nip forming cam 132A and of the second nip forming cam 1328, and a second reference position RP2 representing a zero-degree angular position of the first tension adjustment cam 133A and of the second tension adjustment cam 133B. The first reference position RP1 and the second reference position RP2 in the cam shaft 59 may be located at the same position or at different positions. In the above-described examples, an angular position at which the first nip forming cam 132A and the second nip forming cam 132B respectively contact the first nip forming lever 57A and the second nip forming lever 578, is different from respective angular positions at which the first tension adjustment cam 133A and the second tension adjustment cam 133B respectively contact the first tension adjustment lever 58A and the second tension adjustment lever 588, and therefore the first reference position RP1 and the second reference position RP2 of the cam shaft 59 are located at different angular positions. FIG. 12 illustrates the cam shaft 59, the first nip forming cam 132A, the second nip forming cam 1328, the first tension adjustment cam 133A, and the second tension adjustment cam 1338 as superimposed on each other and so as to align the first reference position RP1 and the second reference position RP2 at the same position, in order to facilitate understanding of the relationship between the cams.

The shaft portion 131 extends in the longitudinal orientation D, and is rotatable about the rotation axis A59 of the cam shaft 59. The shaft portion 131 includes a first end 131A and a second end 131B opposite the first end 131A in a longitudinal direction of the shaft portion 131 that extends in the longitudinal orientation D. The first end 131A extends through the first frame 51A to the outer side of the first frame 51A, and the second end 131B extends through the second frame 51B to the outer side of the second frame 51B. Accordingly, the shaft portion 131 is rotatably supported by the first frame 51A and the second frame 51B such that the rotation axis A59 extends in the longitudinal orientation D. Namely, the first end 131A of the shaft portion 131 is rotatably supported by the first frame 51A, and the second end 131B of the shaft portion 131 is rotatably supported by the second frame 51B. The shaft portion 131 is rotationally driven by a drive device 134 such as a motor. The drive device 134 is controlled to be rotationally driven by, for example, the controller 70.

Figure 13:
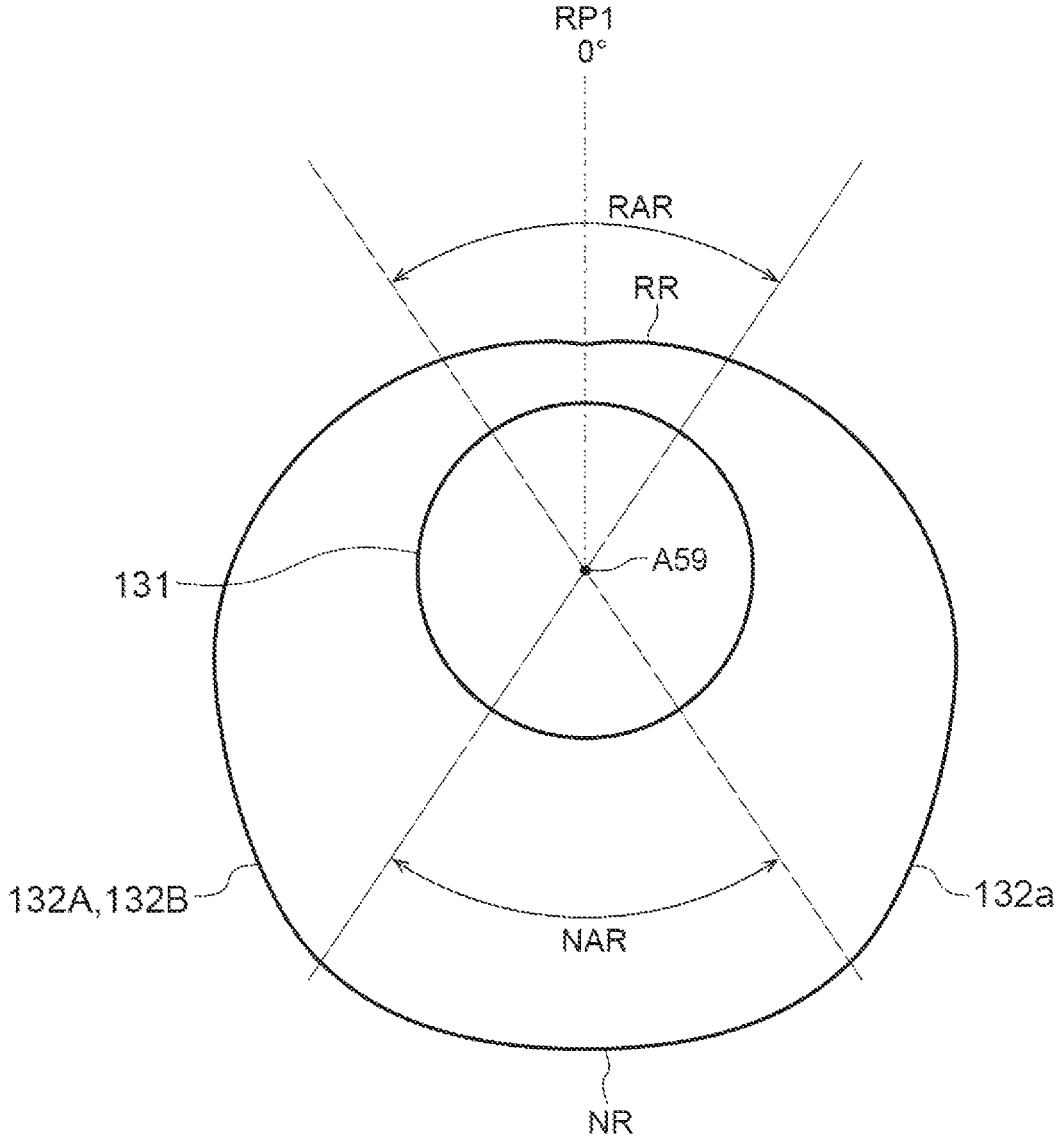
FIG. 13 is a schematic cross-sectional view illustrating the shape of nip forming cams.

FIG. 13 illustrates a shape of the nip forming cams 132A, 132B. With reference to FIGS. 2 to 13, the first nip forming cam 132A and the second nip forming cam 132B are cams that move (displace) the nip roller 55 between the pressed position and the retracted position. The first nip forming cam 132A, the second nip forming cam 1328, the first nip forming lever 57A, and the second nip forming lever 57B form a nip forming device that moves the nip roller 55 between the pressed position (cf. FIG. 10) and the retracted position (cf. FIG. 11). As described above, the pressed position is a position in which the nip roller 55 is pressed against the endless belt 52, for example, to such an extent that an outer peripheral portion of the nip roller 55 is elastically deformed. In addition, the retracted position is a position in which the nip roller 55 is retracted from the endless belt 52. For example, during printing, the image forming apparatus 1 causes the nip forming device to position the nip roller 55 in the pressed position. Accordingly, the nip N is formed between the nip roller 55 and the endless belt 52, so that the toner images on the sheet M can be fixed to the sheet M in the nip N. On the other hand, during non-printing, the image forming apparatus 1 causes the nip forming device to position the nip roller 55 in the retracted position. Accordingly, the pressing of the endless belt 52 by the nip roller 55 is released, so as to suppress a wear or a degradation of the endless belt 52. The period of printing is a period during which the image forming apparatus 1 rotates the endless belt 52 while performing a printing operation. The period of non-printing is a period during which the image forming apparatus 1 rotates the endless belt 52 without performing a printing operation. Examples of such period of non-printing include a period from the end of a printing operation to the stop of the operation of the image forming apparatus 1, or a period during which the temperature of the endless belt 52 is increased, as a preparatory stage for a printing operation.

The first nip forming cam 132A is disposed at the first end 131A of the shaft portion 131 and on an outer side of the first frame 51A. The second nip forming cam 132B is disposed at the second end 131B of the shaft portion 131 and on an outer side of the second frame 51B. The first nip forming cam 132A and the second nip forming cam 132B have similar configurations, and therefore the first nip forming cam 132A and the second nip forming cam 132B may be collectively referred to herein as a nip forming cam 132 unless otherwise specified.

The nip forming cams 132A, 132B have contact surfaces 132*a* (cf. FIG. 12) that respectively contact the roller 112A of the first nip forming lever 57A, and the roller 112B of the second nip forming lever 57B. Namely, the contact surface 132*a* of the first nip forming cam 132A contacts the roller 112A of the first nip forming lever 57A, and the contact surface 132*a* of the second nip forming cam 132B contacts the roller 112B of the second nip forming lever 57B. The contact surface 132*a* may include, for example, a radial outer surface of each of the nip forming cams 132A, 132B. The contact surface 132*a* includes a nip forming surface region NR and a retraction surface region RR (cf. FIG. 13).

The nip forming surface region NR is a partial region of the contact surface 132*a* that positions the nip roller 55 in the pressed position. Namely, when the nip forming surface region NR of first nip forming cam 132A contacts the roller 112A of the first nip forming lever 57A and the nip forming surface region NR of second nip forming cam 132B contacts the roller 112B of the second nip forming lever 57B, the first nip forming cam 132A and the second nip forming cam 132B pivot the first nip forming lever 57A and the second nip forming lever 57B, respectively, to position the nip roller 55 in the pressed position. The nip forming surface region NR extends about the rotation axis A59 of the cam shaft 59 along a nip forming angular range NAR relative to the first reference position RP1 of the cam shaft 59. The nip forming angular range NAR is an angular range along which the nip forming surface region NR is formed, and extends along a range of 150° to 210° relative to first reference position RP1 in the example illustrated in FIG. 13. In order to suppress fluctuations in the pressing force of the nip roller 55 against the endless belt 52 when the nip forming cams 132A, 132B rotate in a state where the nip roller 55 is in the pressed position, the nip forming surface region NR may extend along a circular arc at a substantially constant distance from the rotation axis A59 of the cam shaft 59.

For example, as illustrated in FIG. 5, in a state where the nip forming surface region NR contacts the roller 112A of the first nip forming lever 57A and the roller 112B of the second nip forming lever 578, the outer peripheral portion of the nip roller 55 is pressed against the endless belt 52 to be elastically contracted. Then, the reaction force of the endless belt 52 against the nip roller 55, the elastic restoring force of the outer peripheral portion of the nip roller 55, and the biasing force of the first biasing member 114A and the second biasing member 114B are balanced out, so that the pin 111A is disposed toward a center of the slot 113A and the pin 111B is disposed toward a center of the slot 1138, respectively. Namely, in the first nip forming lever 57A and the second nip forming lever 578, the slot 113A and the slot 1138 are slidable in the direction in which the nip roller 55 moves both toward and away from the endless belt 52.

The retraction surface region RR is a partial region of the contact surface 132*a*, to position the nip roller 55 in the retracted position. Namely, when the retraction surface region RR contacts the roller 112A of the first nip forming lever 57A and the roller 112B of the second nip forming lever 578, the first nip forming cam 132A and the second nip forming cam 132B pivot the first nip forming lever 57A and the second nip forming lever 57B, respectively, to position the nip roller 55 in the retracted position. The retraction surface region RR extends about the rotation axis A59 of the cam shaft 59 along a retraction angular range RAR relative to the first reference position RP1 of the cam shaft 59. The retraction angular range RAR is an angular range in which the retraction surface region RR is formed, and extends along a range of 322.5° to 37.5° (range of 322.5° to 360° and 0° to 37.5°) relative to first reference position RP1 in the example illustrated in FIG. 15.

For example, with reference to FIG. 8, in a state where the retraction surface region RR contacts the roller 112A of the first nip forming lever 57A and the roller 112B of the second nip forming lever 57B, the biasing force of the first biasing member 114A and the second biasing member 114B restricts the slot 113A and the slot 113B from sliding in the direction that causes the nip roller 55 to move toward the endless belt 52. Then, the first nip forming lever 57A and the second nip forming lever 57B are pivoted about the respective pins 111A and 111B, by the biasing force of the first biasing member 114A and the second biasing member 114B, respectively, to move the nip roller 55 away from the endless belt 52.

Figure 14:
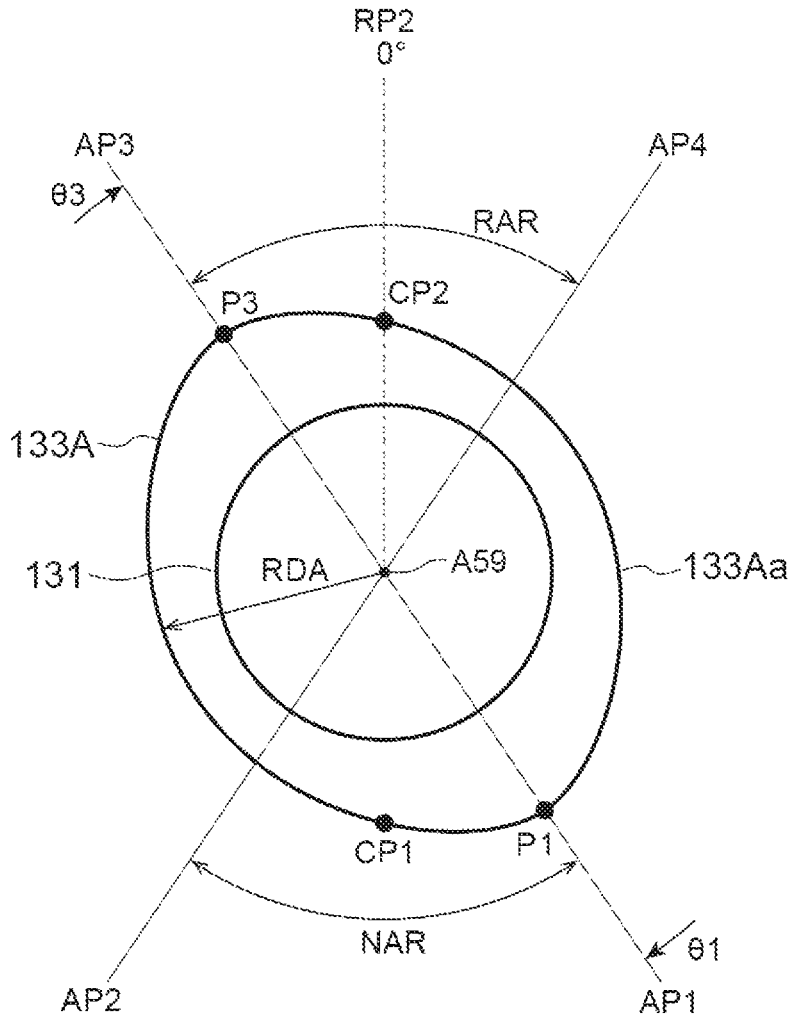
FIG. 14 is a schematic cross-sectional view illustrating the shape of a first tension adjustment cam.
Figure 15:
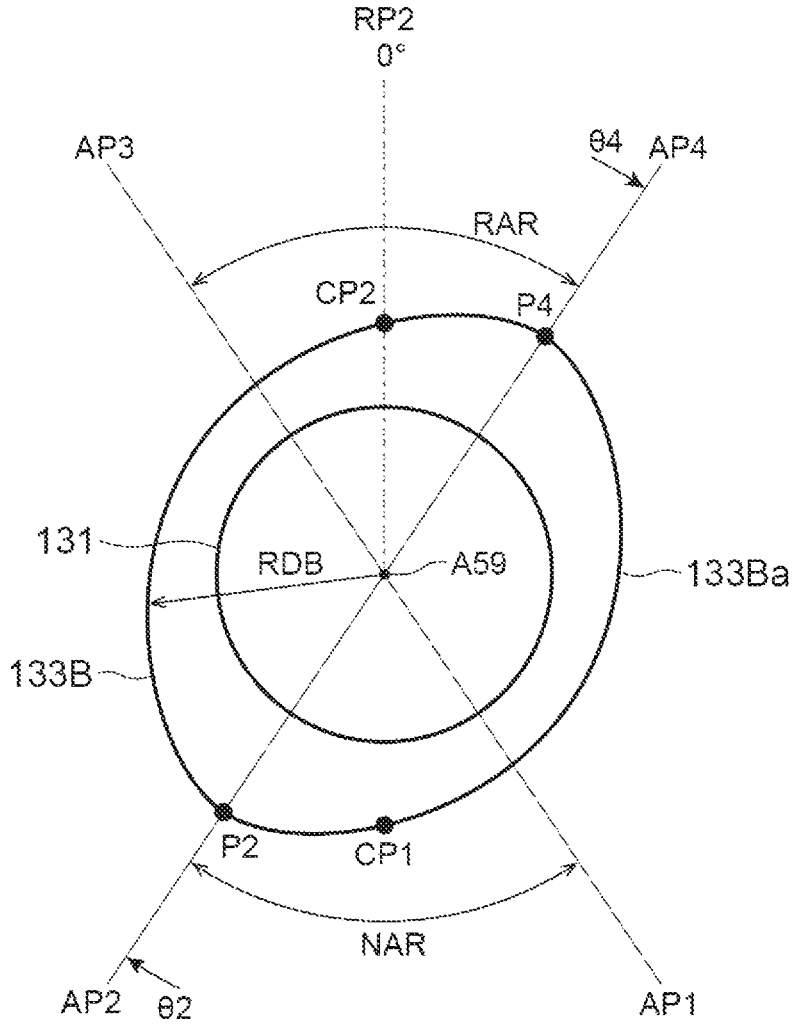
FIG. 15 is a schematic cross-sectional view illustrating the shape of a second tension adjustment cam.

FIGS. 14 and 15 illustrate the first tension adjustment cam 133A and the second tension adjustment cam 133B. With reference to FIGS. 2 to 15, the first tension adjustment cam 133A and the second tension adjustment cam 133B move the adjustment roller 54 relative to the tension roller 53. For example, the first tension adjustment cam 133A and the second tension adjustment cam 133B move the adjustment roller 54 relative to the tension roller 53 in order to reduce the tension of the endless belt 52 to suppress a wearing or degradation of the endless belt 52. In addition, the movement of the adjustment roller 54 relative to the tension roller 53 by the first tension adjustment cam 133A and the second tension adjustment cam 133B corrects a misalignment of the endless belt 52 in along the longitudinal direction (or orientation) D. The first tension adjustment cam 133A, the second tension adjustment cam 1338, the first tension adjustment lever 58A, and the second tension adjustment lever 58B form a tension adjustment device that corrects a misalignment of the endless belt 52 in the longitudinal direction (or orientation) D when the endless belt 52 rotates.

The first tension adjustment cam 133A moves the first end 54A of the adjustment roller 54. The first tension adjustment cam 133A rotates about the rotation axis A59 of the cam shaft 59 to move the first end 54A of the adjustment roller 54 toward and away from the tension roller 53. The first tension adjustment cam 133A is disposed at the first end 131A of the shaft portion 131 and on the inner side of the first frame 51A. The second tension adjustment cam 133B moves the second end 54B of the adjustment roller 54. The second tension adjustment cam 133B rotates about the rotation axis A59 of the cam shaft 59 to move the second end 54B of the adjustment roller 54 toward and away from the tension roller 53. The second tension adjustment cam 1338 is disposed at the second end 131B of the shaft portion 131 and on the inner side of the second frame 51B. With reference to FIG. 12, a first apex P1 is formed on the first tension adjustment cam 133A, a second apex P2 is formed on the second tension adjustment cam 1338, a third apex P3 is formed on the first tension adjustment cam 133A, and a fourth apex P4 is formed on the second tension adjustment cam 133B. The first tension adjustment cam 133A and the second tension adjustment cam 1338 have similar configurations, and therefore the first tension adjustment cam 133A and the second tension adjustment cam 133B may be collectively referred to herein as a tension adjustment cam 133 unless otherwise specified.

With reference to FIGS. 12 and 14, the first tension adjustment cam 133A has a contact surface 133Aa that contacts the contact surface 123A of the first tension adjustment lever 58A. The contact surface 133Aa is, for example, a radial outer surface of the first tension adjustment cam 133A. The contact surface 133Aa of the first tension adjustment cam 133A forms the first apex P1 and the third apex P3. The first apex P1 and the third apex P3 are points to which distances from the rotation axis A59 of the cam shaft 59 are maximum. The distance from the rotation axis A59 of the cam shaft 59 to the first apex P1 and the distance from the rotation axis A59 of the cam shaft 59 to the third apex P3 may be the same or may be different from each other. With reference to the example illustrated in FIGS. 12 and 14, the distance from the rotation axis A59 of the cam shaft 59 to the first apex P1 and the distance from the rotation axis A59 of the cam shaft 59 to the third apex P3 are different from each other. It will be understood that these different distances are not necessarily illustrated to scale in the drawings.

The first apex P1 of the first tension adjustment cam 133A is positioned to move the first end 54A of the adjustment roller 54 toward the tension roller 53 when the nip forming cams 132A, 132B position the nip roller 55 in the pressed position (cf. FIG. 10). Namely, when the first tension adjustment cam 133A rotates about the rotation axis A59 of the cam shaft 59 to move the first apex P1 toward the contact surface 123A of the first tension adjustment lever 58A, the first tension adjustment lever 58A is pivoted to move the first end 54A of the adjustment roller 54 toward the tension roller 53. In addition, when the first tension adjustment cam 133A rotates about the rotation axis A59 of the cam shaft 59 to move the first apex P1 away from the contact surface 123A of the first tension adjustment lever 58A, the first tension adjustment lever 58A is pivoted to move the first end 54A of the adjustment roller 54 away from the tension roller 53 (cf. FIG. 6).

The third apex P3 of the first tension adjustment cam 133A is positioned to move the first end 54A of the adjustment roller 54 toward the tension roller 53 when the nip forming cams 132A, 132B position the nip roller 55 in the retracted position (cf. FIG. 11). Namely, when the first tension adjustment cam 133A rotates about the rotation axis A59 of the cam shaft 59 to move the third apex P3 toward the contact surface 123A of the first tension adjustment lever 58A, the first tension adjustment lever 58A is pivoted to move the first end 54A of the adjustment roller 54 toward the tension roller 53. In addition, when the first tension adjustment cam 133A rotates about the rotation axis A59 of the cam shaft 59 to move the third apex P3 away from the contact surface 123A of the first tension adjustment lever 58A, the first tension adjustment lever 58A is pivoted to move the first end 54A of the adjustment roller 54 away from the tension roller 53 (cf. FIG. 9).

With reference to FIGS. 12 and 15, the second tension adjustment cam 133B has a contact surface 133Ba that contacts the contact surface 123B of the second tension adjustment lever 58B. The contact surface 133Ba is, for example, a radial outer surface of the second tension adjustment cam 133B.

The contact surface 133Ba of the second tension adjustment cam 133B forms the second apex P2 and the fourth apex P4. The second apex P2 and the fourth apex P4 are points to which the distances from the rotation axis A59 of the cam shaft 59 are maximum. The distance from the rotation axis A59 of the cam shaft 59 to the second apex P2 and the distance from the rotation axis A59 of the cam shaft 59 to the fourth apex P4 may be the same or may be different from each other. With reference to the example illustrated in FIGS. 12 and 15, the distance from the rotation axis A59 of the cam shaft 59 to the second apex P2 and the distance from the rotation axis A59 of the cam shaft 59 to the fourth apex P4 are different from each other. It will be understood that these different distances are not necessarily illustrated to scale in the drawings. According to some examples, the first tension adjustment cam 133A and the second tension adjustment cam 133B may be formed in the same shape.

The second apex P2 of the second tension adjustment cam 1338 is positioned to move the second end 54B of the adjustment roller 54 toward the tension roller 53 when the nip forming cams 132A, 132B position the nip roller 55 in the pressed position (cf. FIG. 10). Namely, when the second tension adjustment cam 133B rotates about the rotation axis A59 of the cam shaft 59 to move the second apex P2 toward the contact surface 123B of the second tension adjustment lever 58B, the second tension adjustment lever 58B is pivoted to move the second end 54B of the adjustment roller 54 toward the tension roller 53. In addition, when the second tension adjustment cam 133B rotates about the rotation axis A59 of the cam shaft 59 to move the second apex P2 away from the contact surface 123B of the second tension adjustment lever 58B, the second tension adjustment lever 58B is pivoted to move the second end 54B of the adjustment roller 54 away from the tension roller 53 (cf. FIG. 6).

The fourth apex P4 of the second tension adjustment cam 133B is positioned to move the second end 54B of the adjustment roller 54 toward the tension roller 53 when the nip forming cams 132A, 132B position the nip roller 55 in the retracted position (cf. FIG. 11). Namely, when the second tension adjustment cam 133B rotates about the rotation axis A59 of the cam shaft 59 to move the fourth apex P4 toward the contact surface 123B of the second tension adjustment lever 588, the second tension adjustment lever 58B is pivoted to move the second end 54B of the adjustment roller 54 toward the tension roller 53. In addition, when the second tension adjustment cam 133B rotates about the rotation axis A59 of the cam shaft 59 to move the fourth apex P4 away from the contact surface 1238 of the second tension adjustment lever 588, the second tension adjustment lever 58B is pivoted to move the second end 54B of the adjustment roller 54 away from the tension roller 53 (cf. FIG. 9).

As illustrated in FIGS. 12 to 15, the angular position of the first apex P1 in the cam shaft 59 is referred to as a first angular position AP1, the angular position of the second apex P2 in the cam shaft 59 is referred to as a second angular position AP2, the angular position of the third apex P3 in the cam shaft 59 is referred to as a third angular position AP3, and the angular position of the fourth apex P4 in the cam shaft 59 is referred to as a fourth angular position AP4. The first angular position AP1, the second angular position AP2, the third angular position AP3, and the fourth angular position AP4 are the angular positions in a cross-section of the cam shaft 59 in a rotational direction of the cam shaft 59, relative to the reference position RP2. In some examples, when a selected angular position of the cam shaft 59 is set as a reference angular position, the first angular position AP1, the second angular position AP2, the third angular position AP3, and the fourth angular position AP4 are angular positions relative to the reference angular position.

In the illustrated examples, the first tension adjustment cam 133A and the second tension adjustment cam 133B are disposed such that the first angular position AP1 and the second angular position AP2 are at different positions and the third angular position AP3 and the fourth angular position AP4 are at different positions. Consequently, the first apex P1 and the second apex P2 are located at different angular positions in the rotational direction of the cam shaft 59. Similarly, the third apex P3 and the fourth apex P4 are located at different angular positions in the rotational direction of the cam shaft 59. Additionally, the cam shaft 59 includes a first pole CP1 at an angular center between the first angular position AP1 and the second angular position AP2, and a second pole CP2 at an angular center between the third angular position AP3 and the fourth angular position AP4.

The first apex P1 of the first tension adjustment cam 133A forms a first angle θ1 about the rotation axis A59 of the cam shaft 59 with the second reference position RP2 of the cam shaft 59. The first angle θ1 is within the nip forming angular range NAR associated with the nip forming cams 132A, 132B. Namely, the first angle θ1 is within the nip forming angular range NAR relative to the first reference position RP1 of the cam shaft 59 (cf. FIGS. 12 and 13).

The second apex P2 of the second tension adjustment cam 133B forms a second angle θ2 about the rotation axis A59 of the cam shaft 59 with the second reference position RP2 of the cam shaft 59. The second angle θ2 is within the nip forming angular range NAR associated with the nip forming cams 132A, 132B. Namely, the second angle θ2 is within the nip forming angular range NAR relative to the first reference position RP1 of the cam shaft 59 (cf. FIGS. 12 and 13).

The third apex P3 of the first tension adjustment cam 133A forms a third angle θ3 about the rotation axis A59 of the cam shaft 59 with the second reference position RP2 of the cam shaft 59. The third angle θ3 is within the retraction angular range RAR associated with the nip forming cams 132A, 132B. Namely, the third angle θ3 is within the retraction angular range RAR relative to the first reference position RP1 of the cam shaft 59 (cf. FIGS. 12 and 13).

The fourth apex P4 of the second tension adjustment cam 133B forms a fourth angle θ4 about the rotation axis A59 of the cam shaft 59 with the second reference position RP2 of the cam shaft 59. The fourth angle θ4 is within the retraction angular range RAR associated with the nip forming cams 132A, 132B. Namely, the fourth angle θ4 is within the retraction angular range RAR relative to the first reference position RP1 of the cam shaft 59 (cf. FIGS. 12 and 13).

With reference to FIG. 14, a radial distance RDA between the contact surface 133Aa of the first tension adjustment cam 133A and the rotation axis A59 of the cam shaft 59 decreases from the first angular position AP1 to the first pole CP1, and from the first pole CP1 to the second angular position AP2. In addition, the radial distance RDA decreases from the third angular position AP3 to the second pole CP2, and from the second pole CP2 to the fourth angular position AP4.

With reference to FIG. 15, a radial distance RDB between the contact surface 133Ba of the second tension adjustment cam 133B and the rotation axis A59 of the cam shaft 59 decreases from the second angular position AP2 to the first pole CP1, and from the first pole CP1 to the first angular position AP1. In addition, the radial distance RDB decreases from the fourth angular position AP4 to the second pole CP2, and from the second pole CP2 to the third angular position AP3.

With reference to FIGS. 4 to 6 and 12 to 15, the contact surface 133Aa of the first tension adjustment cam 133A is shaped at the first apex P1 to position the first end 54A of the adjustment roller 54 at a first distance from the tension roller 53. In addition, the contact surface 133Aa is shaped at the first pole CP1 to position the first end 54A of the adjustment roller 54 at a second distance from the tension roller 53. In addition, the contact surface 133Aa is shaped at the second angular position AP2 to position the first end 54A of the adjustment roller 54 at a third distance from the tension roller 53. On the other hand, the contact surface 133Ba of the second tension adjustment cam 133B is shaped at the first angular position AP1 to position the second end 54B of the adjustment roller 54 at the third distance from the tension roller 53. In addition, the contact surface 133Ba is shaped at the first pole CP1 to position the second end 54B of the adjustment roller 54 at the second distance from the tension roller 53. In addition, the contact surface 133Ba is shaped at the second apex P2 to position the second end 54B of the adjustment roller 54 at the first distance from the tension roller 53. The first distance is less than the second distance, and the third distance is greater than the second distance.

Consequently, when the first pole CP1 of the first tension adjustment cam 133A contacts the contact surface 123A of the first tension adjustment lever 58A, the first pole CP1 of the second tension adjustment cam 133B contacts the contact surface 123B of the second tension adjustment lever 58B, and the nip forming surface regions NR of the respective nip forming cams 132A, 132B contact the rollers 112A, 112B of the nip forming levers 57A, 576, respectively. This state is referred to as a nip forming normal state. In the nip forming normal state, the nip roller 55 is positioned in the pressed position. In addition, in the nip forming normal state, a distance between the first end 54A of the adjustment roller 54 and the tension roller 53 and a distance between the second end 54B of the adjustment roller 54 and the tension roller 53 are equal and correspond to the second distance. Consequently, the tension of the first end 52A of the endless belt 52 and the tension of the second end 52B of the endless belt 52 are equal. Accordingly, the endless belt 52 rotates to travel in the direction orthogonal to the longitudinal direction (or orientation) D in a state where the nip N is formed between the endless belt 52 and the nip roller 55.

Figure 16:
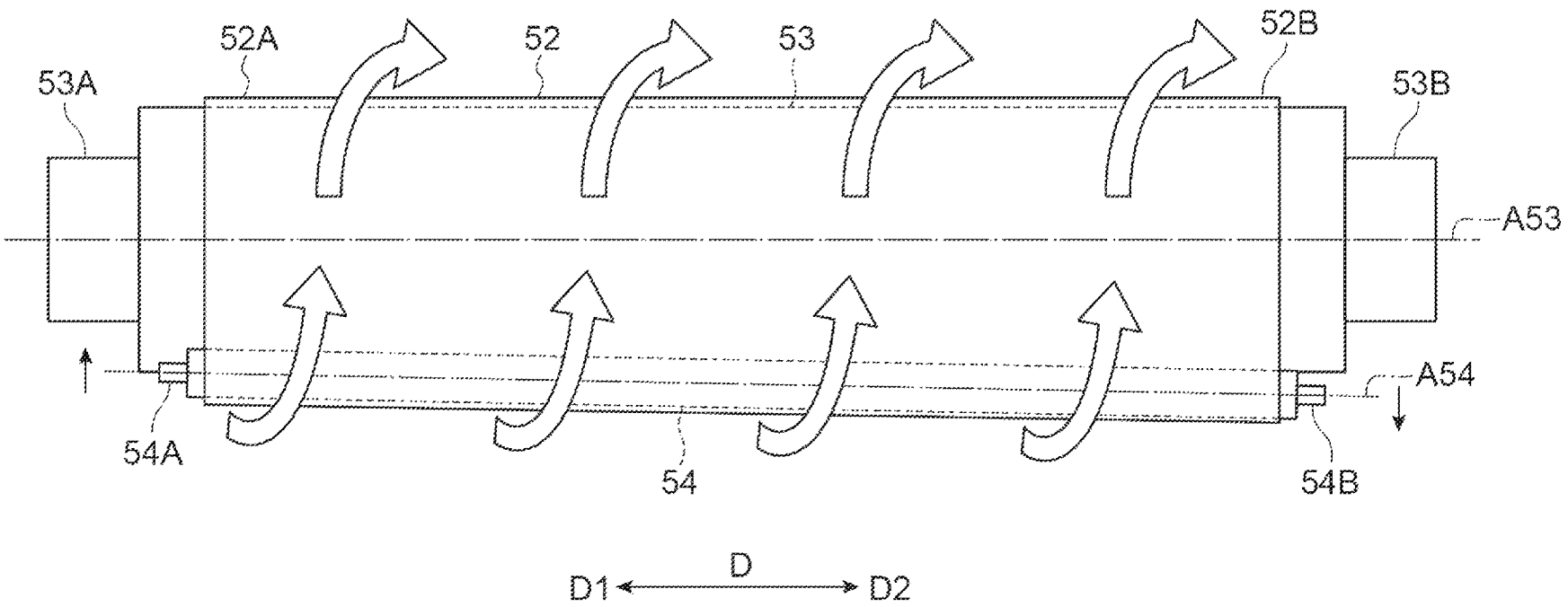
FIG. 16 is a schematic diagram illustrating an example state of the endless belt of the example fixing device.

FIG. 16 illustrates an example state in which the position of the endless belt is corrected when the nip roller is in the pressed position. With reference to FIGS. 4 to 6, 10, and 12 to 16, when the first apex P1 of the first tension adjustment cam 133A contacts the contact surface 123A of the first tension adjustment lever 58A, the first angular position AP1 of the second tension adjustment cam 1338 contacts the contact surface 123B of the second tension adjustment lever 588, and the nip forming surface regions NR of the first nip forming cam 132A and of the second nip forming cam 132B contact the roller 112A of the first nip forming lever 57A and the roller 112B of the second nip forming lever 578, respectively. This state is referred to as a first nip forming tension adjustment state. In the first nip forming tension adjustment state, the nip roller 55 is located in the pressed position. In addition, in the first nip forming tension adjustment state, the distance between the first end 54A of the adjustment roller 54 and the tension roller 53 corresponds to the first distance which is less than the above-mentioned second distance (e.g., an intermediate distance between the first and third distances), and the distance between the second end 54B of the adjustment roller 54 and the tension roller 53 corresponds to the third distance which is greater than the second distance. Consequently, the tension at the first end 52A of the endless belt 52 is less than the tension at the second end 52B of the endless belt 52. Additionally, the amount of penetration of the endless belt 52 into a gap between the tension roller 53 and the adjustment roller 54 by the pressing force of the nip roller 55 is greater at the first end 52A of the endless belt 52 than at the second end 52B of the endless belt 52, so that the amount of winding around the adjustment roller 54 is greater at the first end 54A than at the second end 54B of the adjustment roller 54. Accordingly, the endless belt 52 is twisted, thereby generating a spiral force in the second direction D2. As a result, the endless belt 52 moves in the second direction D2.

Consequently, when for example, the position of the endless belt 52 that is misaligned in the first direction D1 because of meandering or the like is corrected during printing, the cam shaft 59 is rotated such that the nip forming surface regions NR of the first nip forming cam 132A and of the second nip forming cam 132B contact the roller 112A of the first nip forming lever 57A and the roller 112B of the second nip forming lever 57B, respectively, the first apex P1 of the first tension adjustment cam 133A contacts the contact surface 123A of the first tension adjustment lever 58A, and the first angular position AP1 of the second tension adjustment cam 133B contacts the contact surface 123B of the second tension adjustment lever 58B. Accordingly, the position of the endless belt 52 that is misaligned in the first direction D1 because of meandering or the like, can be moved in the second direction D2, so as to correct the position of the endless belt 52.

Figure 17:
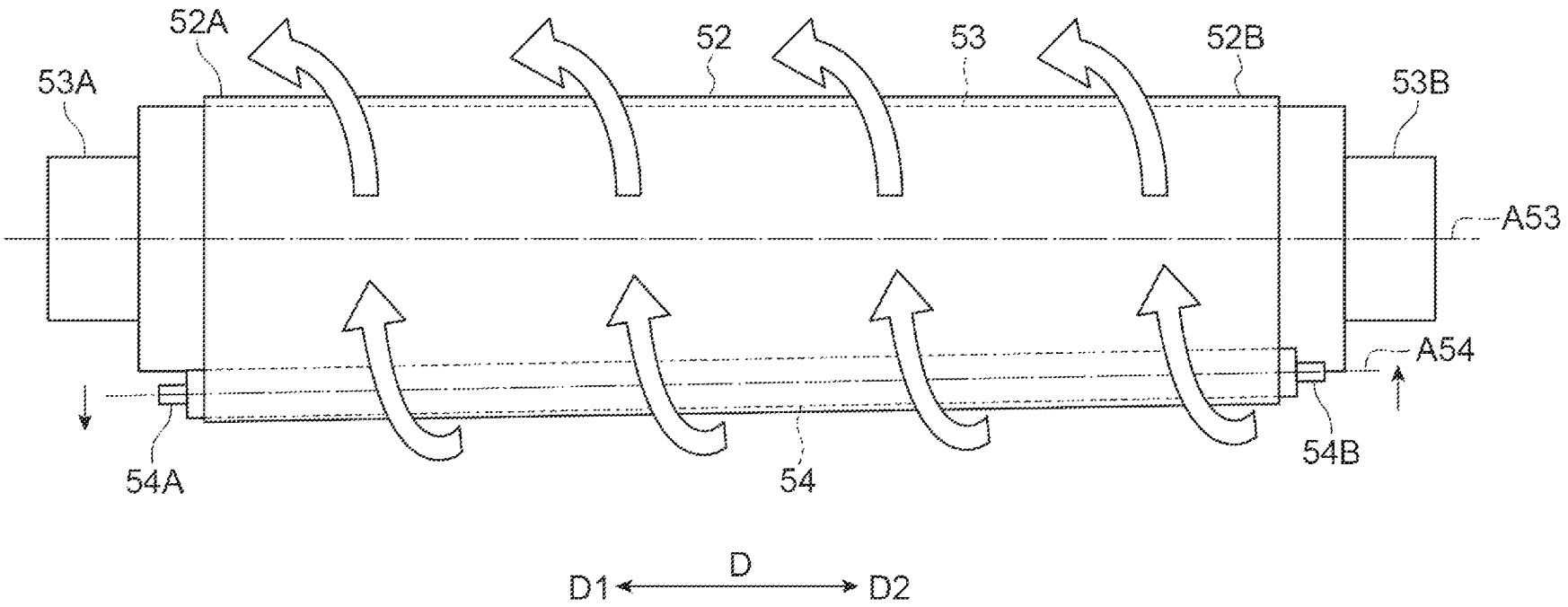
FIG. 17 is a schematic diagram illustrating another example state of the endless belt.

FIG. 17 is a schematic view illustrating another example of a state where the position of the endless belt is corrected when the nip roller is in the pressed position. As illustrated in FIGS. 4 to 6, 10, 12 to 15, and 17, when the second angular position AP2 of the first tension adjustment cam 133A contacts the contact surface 123A of the first tension adjustment lever 58A, the second apex P2 of the second tension adjustment cam 133B contacts the contact surface 123B of the second tension adjustment lever 588, and the nip forming surface regions NR of the first nip forming cam 132A and of the second nip forming cam 132B contact the roller 112A of the first nip forming lever 57A and the roller 112B of the second nip forming lever 578, respectively. This state is referred to as a second nip forming tension adjustment state. In the second nip forming tension adjustment state, the nip roller 55 is located in the pressed position. In addition, in the second nip forming tension adjustment state, the distance between the first end 54A of the adjustment roller 54 and the tension roller 53 corresponds to the third distance which is greater than the afore-mentioned second distance, and the distance between the second end 54B of the adjustment roller 54 and the tension roller 53 corresponds to the first distance which is less than the second distance. Consequently, the tension at the second end 52B of the endless belt 52 is less than the tension at the first end 52A of the endless belt 52. Additionally, the amount of penetration of the endless belt 52 into the gap between the tension roller 53 and the adjustment roller 54 by the pressing force of the nip roller 55 is greater at the second end 52B of the endless belt 52 than at the first end 52A of the endless belt 52, so that the amount of winding around the adjustment roller 54 is greater at the at the second end 54B than at the first end 54A of the adjustment roller 54. Accordingly, the endless belt 52 is twisted, thereby generating a spiral force in the first direction D1. As a result, the endless belt 52 moves in the first direction D1.

Consequently, when for example, the position of the endless belt 52 that is misaligned in the second direction D2 because of meandering or the like is corrected during printing, the cam shaft 59 is rotated such that the nip forming surface regions NR of the first nip forming cam 132A and of the second nip forming cam 132B contact the roller 112A of the first nip forming lever 57A and the roller 112B of the second nip forming lever 57B, respectively, the second angular position AP2 of the first tension adjustment cam 133A contacts the contact surface 123A of the first tension adjustment lever 58A, and the second apex P2 of the second tension adjustment cam 133B contacts the contact surface 123B of the second tension adjustment lever 58B. Accordingly, the position of the endless belt 52 that is misaligned in the second direction D2 because of meandering or the like can be moved in the first direction D1, so as to correct the position of the endless belt 52.

As illustrated in FIGS. 7 to 9 and 12 to 15, the contact surface 133Aa of the first tension adjustment cam 133A is shaped at the third apex P3 to position the first end 54A of the adjustment roller 54 at a fourth distance from the tension roller 53. In addition, the contact surface 133Aa is shaped at the second pole CP2 to position the first end 54A of the adjustment roller 54 at a fifth distance from the tension roller 53. In addition, the contact surface 133Aa is shaped at the fourth angular position AP4 to position the first end 54A of the adjustment roller 54 at a sixth distance from the tension roller 53. Additionally, the contact surface 133Ba of the second tension adjustment cam 133B is shaped at the third angular position AP3 to position the second end 54B of the adjustment roller 54 at the sixth distance from the tension roller 53. In addition, the contact surface 133Ba is shaped at the second pole CP2 to position the second end 54B of the adjustment roller 54 at the fifth distance from the tension roller 53. In addition, the contact surface 133Ba is shaped at the fourth apex P4 to position the second end 54B of the adjustment roller 54 at the fourth distance from the tension roller 53. The fourth distance is less than the fifth distance, and the sixth distance is greater than the fifth distance.

Consequently, when the second pole CP2 of the first tension adjustment cam 133A contacts the contact surface 123A of the first tension adjustment lever 58A, the second pole CP2 of the second tension adjustment cam 133B contacts the contact surface 123B of the second tension adjustment lever 58B, and the retraction surface regions RR of the first nip forming cam 132A and the second nip forming cam 132B contact the roller 112A of the first nip forming lever 57A and the roller 112B of the second nip forming lever 57B, respectively. This state is referred to as a retraction normal state. In the retraction normal state, the nip roller 55 is located in the retracted position. In addition, in the retraction normal state, the distance between the first end 54A of the adjustment roller 54 and the tension roller 53 and the distance between the second end 54B of the adjustment roller 54 and the tension roller 53 are equal and correspond to the fifth distance. Consequently, the tension of the first end 52A of the endless belt 52 and the tension of the second end 52B of the endless belt 52 are equal. Accordingly, the endless belt 52 rotates to travel in the direction orthogonal to the longitudinal direction (or orientation) D in a state where the endless belt 52 is spaced away from the nip roller 55.

Figure 18:
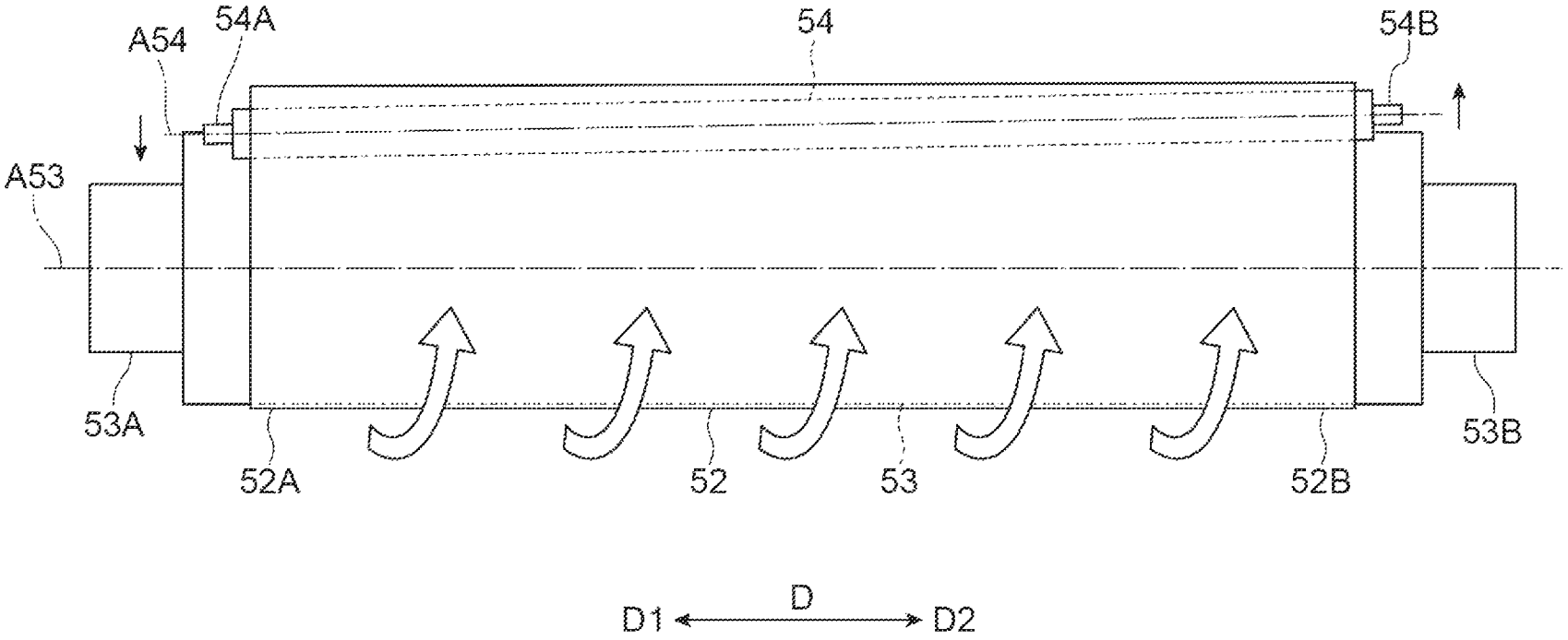
FIG. 18 is a schematic diagram illustrating another example state of the endless belt.

FIG. 18 illustrates an example state in which the position of the endless belt is corrected when the nip roller is in the retracted position. With reference to FIGS. 7 to 9, 11 to 15, and 18, when the third apex P3 of the first tension adjustment cam 133A contacts the contact surface 123A of the first tension adjustment lever 58A, the third angular position AP3 of the second tension adjustment cam 133B contacts the contact surface 123B of the second tension adjustment lever 588, and the retraction surface regions RR of the first nip forming cam 132A and of the second nip forming cam 132B contact the roller 112A of the first nip forming lever 57A and the roller 112B of the second nip forming lever 57B, respectively. This state is referred to as a first retraction tension adjustment state. In the first retraction tension adjustment state, the nip roller 55 is located in the retracted position. In addition, in the first retraction tension adjustment state, the distance between the first end 54A of the adjustment roller 54 and the tension roller 53 corresponds to the fourth distance which is less than the above-mentioned fifth distance (e.g., an intermediate distance between the fourth and sixth distances), and the distance between the second end 54B of the adjustment roller 54 and the tension roller 53 corresponds to the sixth distance which is greater than the fifth distance. Consequently, the tension at the second end 52B of the endless belt 52 is greater than the tension at the first end 52A of the endless belt 52. Accordingly, a difference in the tension of the endless belt 52 is generated, in which the tension increases toward the second direction D2. A driving force from the tension roller 53 transmitted to the endless belt 52 increases with an increased tension, so that the endless belt 52 tends to move to an end at which the tension is greater. In addition, in a tilted position of the adjustment roller 54 relative to the tension roller 53, the endless belt 52 is twisted toward an end at which the distance between the adjustment roller 54 and the tension roller 53 is greater than at the opposite end, so that the endless belt 52 tends to move toward the end at which the distance between the adjustment roller 54 and the tension roller 53 is greater. In addition, since the nip roller 55 is spaced away from the endless belt 52 in the first retraction tension adjustment state, the endless belt 52 is not affected by the nip roller 55. As a result, the endless belt 52 moves in the second direction D2.

Consequently, when for example, the position of the endless belt 52 that is misaligned in the first direction D1 because of meandering or the like is corrected during non-printing, the cam shaft 59 is rotated such that the retraction surface regions RR of the first nip forming cam 132A and of the second nip forming cam 132B contact the roller 112A of the first nip forming lever 57A and the roller 112B of the second nip forming lever 57B, respectively, the third apex P3 of the first tension adjustment cam 133A contacts the contact surface 123A of the first tension adjustment lever 58A, and the third angular position AP3 of the second tension adjustment cam 133B contacts the contact surface 123B of the second tension adjustment lever 58B. Accordingly, the position of the endless belt 52 that is misaligned in the first direction D1 because of meandering or the like, can be moved in the second direction D2, so as to correct the position of the endless belt 52.

Figure 19:
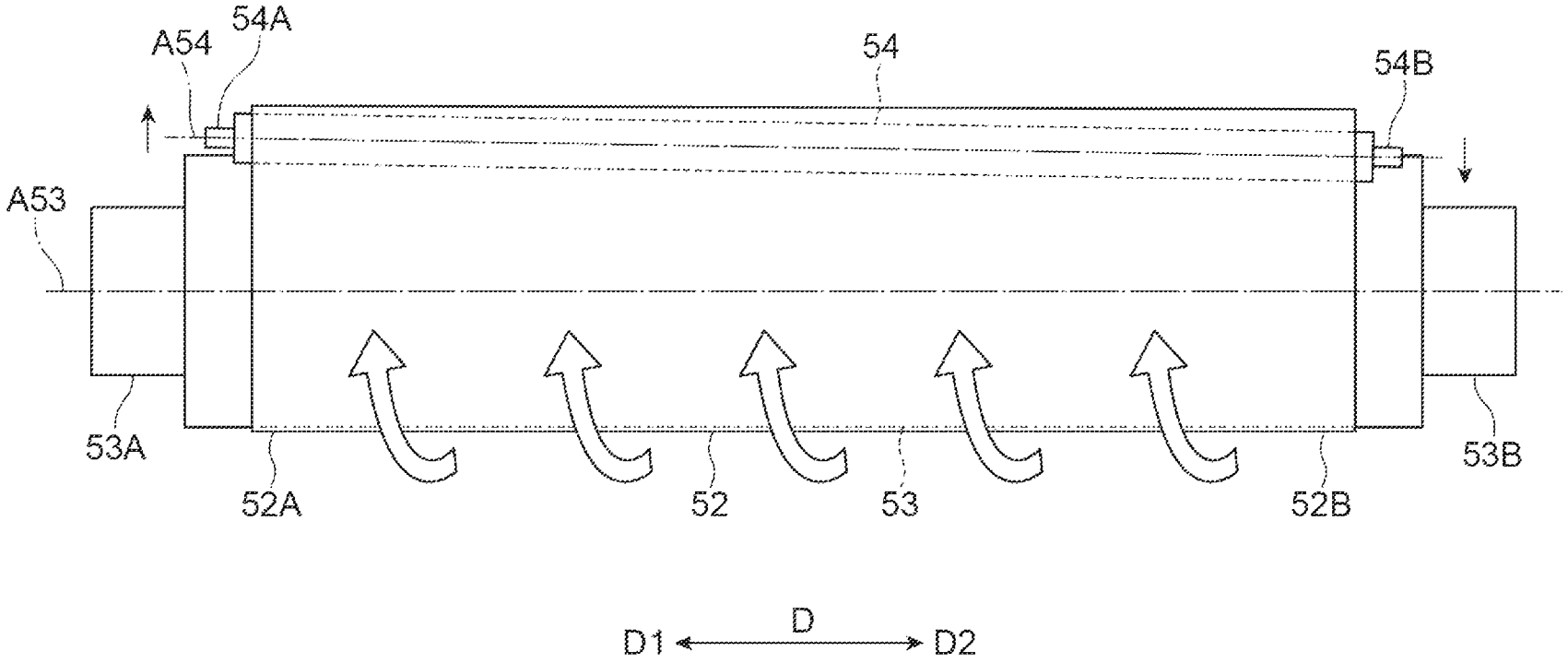
FIG. 19 is a schematic diagram illustrating another example state of the endless belt.

FIG. 19 is a schematic view illustrating another example of a state where the position of the endless belt is corrected when the nip roller is in the retracted position. As illustrated in FIGS. 7 to 9, 11 to 15, and 19, when the fourth angular position AP4 of the first tension adjustment cam 133A contacts the contact surface 123A of the first tension adjustment lever 58A, the fourth apex P4 of the second tension adjustment cam 133B contacts the contact surface 123B of the second tension adjustment lever 588, and the retraction surface regions RR of the first nip forming cam 132A and of the second nip forming cam 132B contact the roller 112A of the first nip forming lever 57A and the roller 112B of the second nip forming lever 576, respectively. This state is referred to as a second retraction tension adjustment state. In the second retraction tension adjustment state, the nip roller 55 is located in the retracted position. In addition, in the second retraction tension adjustment state, the distance between the first end 54A of the adjustment roller 54 and the tension roller 53 corresponds to the sixth distance which is greater than the afore-mentioned fifth distance, and the distance between the second end 54B of the adjustment roller 54 and the tension roller 53 corresponds to the fourth distance which is less than the fifth distance. Consequently, the tension at the first end 52A of the endless belt 52 is greater than the tension at the second end 52B of the endless belt 52. Accordingly, a difference in the tension of the endless belt 52 is generated, in which the tension increases in the first direction D1. In this case, the driving force from the tension roller 53 transmitted to the endless belt 52 increases with an increased tension, so that the endless belt 52 tends to move to an end at which the tension is greater. In addition, a tilted position of the adjustment roller 54 relative to the tension roller 53, the endless belt 52 is twisted toward an end at which the distance between the adjustment roller 54 and the tension roller 53 is greater than at the opposite end, so that the endless belt 52 tends to move toward the end at which the distance between the adjustment roller 54 and the tension roller 53 is greater. In addition, since the nip roller 55 is spaced away from the endless belt 52 in the second retraction tension adjustment state, the endless belt 52 is not affected by the nip roller 55. As a result, the endless belt 52 moves in the first direction D1.

Consequently, when for example, the position of the endless belt 52 that is misaligned in the second direction D2 because of meandering or the like is corrected during non-printing, the cam shaft 59 is rotated such that the retraction surface regions RR of the first nip forming cam 132A and of the second nip forming cam 132B contact the roller 112A of the first nip forming lever 57A and the roller 112B of the second nip forming lever 57B, respectively, the fourth angular position AP4 of the first tension adjustment cam 133A contacts the contact surface 123A of the first tension adjustment lever 58A, and the fourth apex P4 of the second tension adjustment cam 133B contacts the contact surface 123B of the second tension adjustment lever 58B. Accordingly, the position of the endless belt 52 that is misaligned in the second direction D2 because of meandering or the like, can be moved in the first direction D1, so as to correct the position of the endless belt 52.

As described above, the image forming apparatus 1 of this example rotates the nip forming cams 132A, 132B to move the nip roller 55 between the pressed position and the retracted position, so as to switch between the state in which the nip N is formed between the endless belt 52 and the nip roller 55, and the state in which the endless belt 52 is spaced away from the nip roller 55. In addition, the tension of the endless belt 52 can be adjusted by rotating the tension adjustment cams 133A, 133B to move respective ends 54A, 54B of the adjustment roller 54 relative to the tension roller 53. Since the cam shaft 59 includes the nip forming cams 132A, 132B and the tension adjustment cams 133A, 133B, the nip forming cam 132A, 132B and the tension adjustment cams 133A, 133B can be operated by rotating the cam shaft 59. Accordingly, the size and cost of the image forming apparatus 1 can be reduced while extending the lifespan of the image forming apparatus 1.

In addition, the first nip forming cam 132A, the second nip forming cam 132B, the first nip forming lever 57A, and the second nip forming lever 57B forming the nip forming device move the nip roller 55 between the pressed position and the retracted position, so that the example image forming apparatus 1 is capable of switching between the state where the nip N is formed between the endless belt 52 and the nip roller 55, and the state where the nip roller 55 is spaced away from the endless belt 52. Additionally, the first tension adjustment cam 133A, the second tension adjustment cam 133B, the first tension adjustment lever 58A, and the second tension adjustment lever 58B forming the tension adjustment device tilt the adjustment roller 54 relative to the tension roller 53 regardless of whether the nip roller 55 is in the pressed position or the retracted position, so that a misalignment of the endless belt 52 in the longitudinal direction (or orientation) D can be corrected when the endless belt 52 rotates. Accordingly, the lifespan of the image forming apparatus 1 can be extended.

It should be understood that although various examples have been described in the specification, and it is apparent that the dispositions and details can be also modified, depending on examples.

For example, when a misalignment of the endless belt is not corrected, the first apex of the first tension adjustment cam and the second apex of the second tension adjustment cam may be positioned at the same angular position in the rotational direction of the cam shaft. In addition, when the apexes of the first tension adjustment cam and the apexes of the second tension adjustment cam are disposed at different positions in the rotational direction of the cam shaft, a misalignment of the endless belt can be corrected regardless of the position of each apex of the first tension adjustment cam and the second tension adjustment cam.

In some examples, the nip forming cam and the tension adjustment cam may be components of a single cam shaft, or may be components of different cam shafts. In such examples where the nip forming cam and the tension adjustment cam are components of different cam shafts, the adjustment roller 54 is tilted relative to the tension roller 53. Therefore, when the endless belt 52 rotates, a misalignment of the endless belt 52 in the longitudinal direction (or orientation) D can be corrected regardless of whether the nip roller is in the pressed position or the retracted position.

In some examples, the angle of each apex of the first tension adjustment cam and the second tension adjustment cam relative to the second reference position of the cam shaft may not be within the nip forming angular range NAR or the retraction angular range RAR relative to the first reference position of the cam shaft. In such examples where the angular positions of the apexes of the first tension adjustment cam and of the second tension adjustment cam relative to the second reference position of the cam shaft are not within the nip forming angular range NAR or the retraction angular range RAR relative to the first reference position of the cam shaft, the tension of the endless belt in the first direction and in the second direction can be changed by rotating the cam shaft. Namely, a misalignment of the endless belt can be corrected.

In some examples, when a misalignment of the endless belt 52 is corrected during printing, the cam shaft 59 may be rotated such that the vicinity of the first apex P1 of the first tension adjustment cam 133A contacts the contact surface 123A of the first tension adjustment lever 58A and the vicinity of the first angular position AP1 of the second tension adjustment cam 133B contacts the contact surface 123B of the second tension adjustment lever 58B. In such examples, a misalignment of the endless belt 52 can be corrected during printing. In such examples, the vicinity of the first apex P1 of the first tension adjustment cam 133A which contacts the contact surface 123A of the first tension adjustment lever 58A, and the vicinity of the first angular position AP1 of the second tension adjustment cam 133B which contacts the contact surface 123B of the second tension adjustment lever 58B may be regions extending along a predetermined length in the rotational direction of the cam shaft. Even in such examples, a misalignment of the endless belt 52 can be corrected during printing. The same applies to cases where a misalignment of the endless belt 52 is corrected during non-printing.

Figure 20:
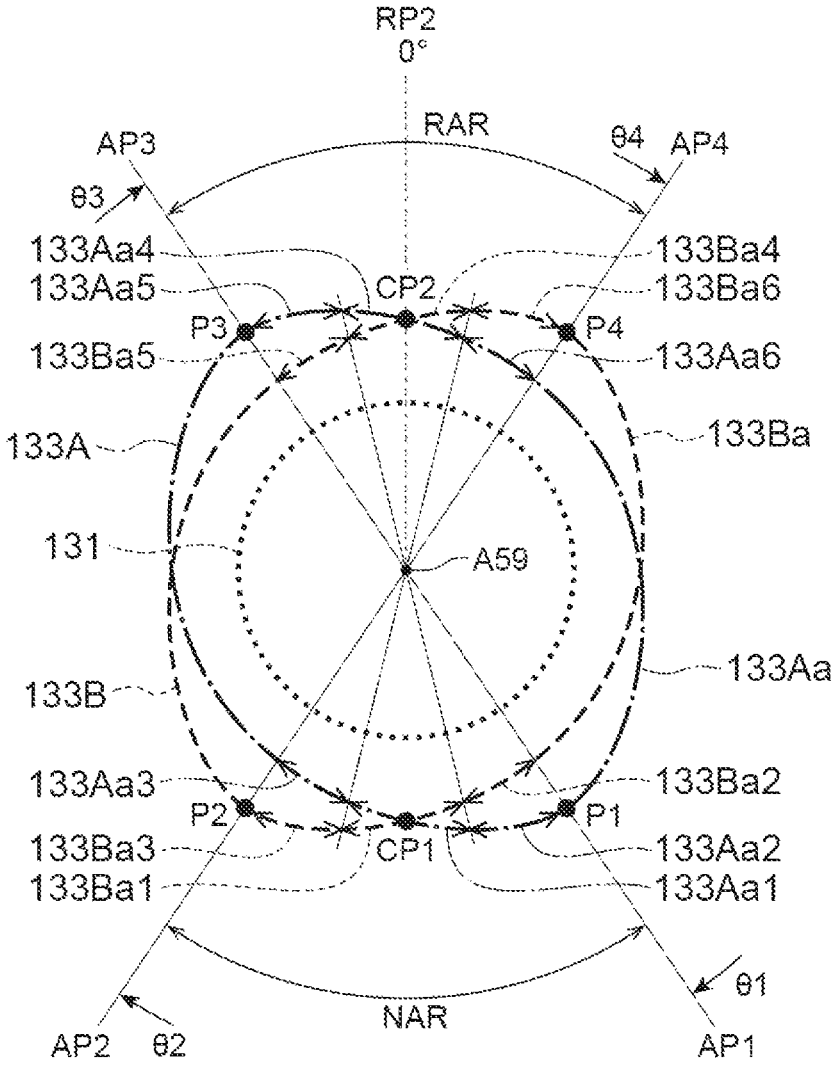
FIG. 20 is a schematic diagram illustrating a first tension adjustment cam and a second tension adjustment cam of another example fixing device.

In some examples, with reference to FIG. 20, the contact surface 133Aa of the first tension adjustment cam 133A may include a central contact surface 133Aa1 including the first pole CP1, a first contact surface 133Aa2 located closer to a first apex P1 relative to the central contact surface 133Aa1 (e.g., located between the central contact surface 133Aa1 and the first apex P1), and a second contact surface 133Aa3 located opposite the first apex P1 relative to the central contact surface 133Aa1 (e.g., located between the central contact surface 133Aa1 and an angular position AP2). Accordingly, the central contact surface 133Aa1 is located between the first contact surface 133Aa2 and the second contact surface 133Aa3. In addition, the contact surface 133Ba of the second tension adjustment cam 133B may include a central contact surface 133Ba1 including the first pole CP1, a first contact surface 133Ba2 located opposite a second apex P2 relative to the central contact surface 133Ba1 (e.g., located between the central contact surface 133Ba1 and an angular position AP1), and a second contact surface 133Ba3 located closer to the second apex P2 relative to the central contact surface 133Ba1 (e.g., located between the central contact surface 133Ba1 and the second apex P2). Accordingly, the central contact surface 133Ba1 is located between the first contact surface 133Ba2 and the second contact surface 133Ba3 of the second tension adjustment cam 133B. In addition, in the nip forming normal state, the central contact surface 133Aa1 of the first tension adjustment cam 133A may contact the contact surface 123A of the first tension adjustment lever 58A, and the central contact surface 133Ba1 of the second tension adjustment cam 133B may contact the contact surface 123B of the second tension adjustment lever 58B. In addition, in the first nip forming tension adjustment state where a misalignment of the endless belt 52 is to be corrected during printing, the first contact surface 133Aa2 of the first tension adjustment cam 133A may contact the contact surface 123A of the first tension adjustment lever 58A, and the first contact surface 133Ba2 of the second tension adjustment cam 133B may contact the contact surface 123B of the second tension adjustment lever 58B. In addition, in the second nip forming tension adjustment state where a misalignment of the endless belt 52 is corrected during printing, the second contact surface 133Aa3 of the first tension adjustment cam 133A may contact the contact surface 123A of the first tension adjustment lever 58A, and the second contact surface 133Ba3 of the second tension adjustment cam 133B may contact the contact surface 123B of the second tension adjustment lever 58B.

Similarly, still with reference to FIG. 20, the contact surface 133Aa of the first tension adjustment cam 133A may include a central contact surface 133Aa4 including the second pole CP2, a third contact surface 133Aa5 located closer to a third apex P3 relative to the central contact surface 133Aa4 (e.g., located between the central contact surface 133Aa4 and the third apex P3), and a fourth contact surface 133Aa6 located opposite the third apex P3 relative to the central contact surface 133Aa4 (e.g., located between the central contact surface 133Aa4 and an angular position AP4). Accordingly, the central contact surface 133Aa4 is located between the third contact surface 133Aa5 and the fourth contact surface 133Aa6. In addition, the contact surface 133Ba of the second tension adjustment cam 133B may include a central contact surface 133Ba4 including the second pole CP2, a third contact surface 133Ba5 located opposite a fourth apex P4 relative to the central contact surface 133Ba4 (e.g., located between the central contact surface 133Ba4 and an angular position AP3), and a fourth contact surface 133Ba6 located closer to the fourth apex P4 relative to the central contact surface 133Ba4 (e.g., located between the central contact surface 133Ba4 and the fourth apex P4). Accordingly, the central contact surface 133Ba4 is located between the third contact surface 133Ba5 and the fourth contact surface 133Ba6 of the second tension adjustment cam 133B. In addition, in the retraction normal state, the central contact surface 133Aa4 of the first tension adjustment cam 133A may contact the contact surface 123A of the first tension adjustment lever 58A, and the central contact surface 133Ba4 of the second tension adjustment cam 133B may contact the contact surface 123B of the second tension adjustment lever 58B. In addition, in the first retraction tension adjustment state where a misalignment of the endless belt 52 is to be corrected during non-printing, the third contact surface 133Aa5 of the first tension adjustment cam 133A may contact the contact surface 123A of the first tension adjustment lever 58A, and the third contact surface 133Ba5 of the second tension adjustment cam 133B may contact the contact surface 123B of the second tension adjustment lever 58B. In addition, in the second retraction tension adjustment state where a misalignment of the endless belt 52 is to be corrected during non-printing, the fourth contact surface 133Aa6 of the first tension adjustment cam 133A may contact the contact surface 123A of the first tension adjustment lever 58A, and the fourth contact surface 133Ba6 of the second tension adjustment cam 133B may contact the contact surface 123B of the second tension adjustment lever 58B.

In some examples, the configuration of the fixing device including the endless belt, the belt rollers including the tension roller and the adjustment roller, the nip roller, and the cam shaft including the nip forming cam and the tension adjustment cam may be used in devices other than the fixing device in an image forming apparatus. Similarly, the configuration of the fixing device including the endless belt, the belt rollers including the tension roller and the adjustment roller, the nip roller, the nip forming device, and the tension adjustment device may be used in devices other than the fixing device in the image forming apparatus.

In some examples, the nip forming device that moves the nip roller between the pressed position and the retracted position, and the tension adjustment device that corrects a misalignment of the endless belt in the longitudinal direction when the endless belt rotates may be achieved without the cam shaft of the above-described examples. For example, a first cam shaft including the first nip forming cam and the first tension adjustment cam, a second cam shaft including the second nip forming cam and the second tension adjustment cam, a first drive device that rotationally drives the first cam shaft, and a second drive device that rotationally drives the second cam shaft may be provided to provide the nip forming device and the tension adjustment device. In this case, for example, the first drive device and the second drive device can be rotationally driven independently of each other to more finely adjust the tension of the endless belt.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. An image forming apparatus comprising:

an endless belt to rotate;

belt rollers including a tension roller and an adjustment roller extending inside the endless belt;

a nip roller extending adjacent the endless belt to form a nip between the nip roller and the endless belt; and a cam shaft that includes:

a nip forming cam to move the nip roller between a pressed position wherein the nip roller is pressed against the endless belt, and a retracted position wherein the nip roller is retracted from the endless belt; and a tension adjustment cam to move the adjustment roller relative to the tension roller, wherein the tension adjustment cam includes:

a first apex to move the adjustment roller toward the tension roller when the nip forming cam positions the nip roller in the pressed position; and a second apex to move the adjustment roller toward the tension roller when the nip forming cam positions the nip roller in the retracted position.

2. The image forming apparatus according to claim 1, wherein the nip forming cam includes a nip forming surface region to position the nip roller in the pressed position, wherein the nip forming surface region extends along a circular arc at a substantially constant distance from a rotation axis of the cam shaft.

3. The image forming apparatus according to claim 1, wherein the cam shaft includes a first reference position representing a zero-degree angular position of the nip forming cam, and a second reference position representing a zero-degree angular position of the tension adjustment cam, wherein the nip forming cam includes:

a nip forming surface region to position the nip roller in the pressed position, wherein the nip forming surface region extends about a rotation axis of the cam shaft along a nip forming angular range relative to the first reference position of the cam shaft; and a retraction surface region to position the nip roller in the retracted position, wherein the retraction surface region extends about the rotation axis along a retraction angular range relative to the first reference position of the cam shaft, wherein the first apex of the tension adjustment cam is located at a first angular position about the rotation axis of the cam shaft, relative to the second reference position of the cam shaft, wherein the first angular position is located within the nip forming angular range associated with the nip forming cam, and wherein the second apex of the tension adjustment cam is located at a second angular position about the rotation axis of the cam shaft, relative to the second reference position of the cam shaft, wherein the second angular position is located within the retraction angular range associated with the nip forming cam.

4. The image forming apparatus according to claim 1, wherein the cam shaft includes a first end and a second end opposite the first end in a longitudinal direction of the cam shaft, wherein the tension adjustment cam is a first tension adjustment cam that is located at the first end of the cam shaft to move a first end of the adjustment roller, wherein the first tension adjustment cam forms the first apex, and wherein the cam shaft includes a second tension adjustment cam that is located at the second end of the cam shaft to move a second end of the adjustment roller, wherein the second tension adjustment cam forms the second apex that is located at an angular position different from the first apex of the first tension adjustment cam, in a rotational direction of the cam shaft.

5. The image forming apparatus according to claim 4, wherein the first apex is positioned to move the first end of the adjustment roller toward the tension roller when the nip forming cam positions the nip roller in the pressed position, wherein the second apex is positioned to move the second end of the adjustment roller toward the tension roller when the nip forming cam positions the nip roller in the pressed position, wherein the first tension adjustment cam forms a third apex that is positioned to move the first end of the adjustment roller toward the tension roller when the nip forming cam positions the nip roller in the retracted position, and wherein the second tension adjustment cam forms a fourth apex that is positioned to move the second end of the adjustment roller toward the tension roller when the nip forming cam positions the nip roller in the retracted position.

6. The image forming apparatus according to claim 5, wherein the cam shaft includes a first reference position representing a zero-degree angular position of the nip forming cam, and a second reference position representing a zero-degree angular position of the first tension adjustment cam, wherein the nip forming cam includes:

a nip forming surface region to position the nip roller in the pressed position, wherein the nip forming surface region extends about a rotation axis of the cam shaft along a nip forming angular range relative to the first reference position of the cam shaft; and a retraction surface region to position the nip roller in the retracted position, wherein the retraction surface region extends about the rotation axis along a retraction angular range relative to the first reference position of the cam shaft, wherein the first apex of the first tension adjustment cam is located at a first angular position about the rotation axis of the cam shaft, relative to the second reference position of the cam shaft, wherein the first angular position is located within the nip forming angular range associated with the nip forming cam, wherein the second apex of the second tension adjustment cam is located at a second angular position about the rotation axis of the cam shaft, relative to the second reference position of the cam shaft, wherein the second angular position is located within the nip forming angular range associated with the nip forming cam, wherein the third apex of the first tension adjustment cam is located at a third angular position about the rotation axis of the cam shaft, relative to the second reference position of the cam shaft, wherein the third angular position is located within the retraction angular range associated with the nip forming cam, and wherein the fourth apex of the second tension adjustment cam is located at a fourth angular position about the rotation axis of the cam shaft, relative to the second reference position of the cam shaft, wherein the fourth angular position is located within the retraction angular range associated with the nip forming cam.

7. The image forming apparatus according to claim 5, wherein the first tension adjustment cam has a contact surface that forms the first apex at a first angular position of the cam shaft, and that forms the third apex at a third angular position located at a position different from the first apex relative to a rotation axis of the cam shaft, wherein the second tension adjustment cam has a contact surface that forms the second apex at a second angular position of the cam shaft, and that forms the fourth apex at a fourth angular position located at a position different from the second apex relative to the rotation axis of the cam shaft, wherein the cam shaft includes a first pole at an angular center between the first angular position and the second angular position, and a second pole at an angular center between the third angular position and the fourth angular position, wherein a radial distance between the contact surface of the first tension adjustment cam and the rotation axis of the cam shaft decreases from the first angular position to the first pole, and additionally decreases from the first pole to the second angular position, and wherein the radial distance decreases from the third angular position to the second pole, and additionally decreases from the second pole to the fourth angular position, and wherein a radial distance between the contact surface of the second tension adjustment cam and the rotation axis of the cam shaft decreases from the second angular position to the first pole, and additionally decreases from the first pole to the first angular position, and wherein the radial distance decreases from the fourth angular position to the second pole, and additionally decreases from the second pole to the third angular position.

8. The image forming apparatus according to claim 7, wherein the contact surface of the first tension adjustment cam is shaped at the first apex to position the first end of the adjustment roller at a first distance from the tension roller, wherein the contact surface is shaped at the first pole to position the first end of the adjustment roller at a second distance from the tension roller, and wherein the contact surface is shaped at the second angular position to position the first end of the adjustment roller at a third distance from the tension roller, and wherein the contact surface of the second tension adjustment cam is shaped at the first angular position to position the second end of the adjustment roller at the third distance from the tension roller, wherein the contact surface is shaped at the first pole to position the second end of the adjustment roller at the second distance from the tension roller, and wherein the contact surface is shaped at the second apex to position the second end of the adjustment roller at the first distance from the tension roller.

9. The image forming apparatus according to claim 7, wherein the contact surface of the first tension adjustment cam is shaped at the third apex to position the first end of the adjustment roller at a fourth distance from the tension roller, wherein the contact surface is shaped at the second pole to position the first end of the adjustment roller at a fifth distance from the tension roller, and wherein the contact surface is shaped at the fourth angular position to position the first end of the adjustment roller at a sixth distance from the tension roller, and wherein the contact surface of the second tension adjustment cam is formed at the third angular position to position the second end of the adjustment roller at the sixth distance from the tension roller, wherein the contact surface is formed at the second pole to position the second end of the adjustment roller at the fifth distance from the tension roller, and wherein the contact surface is formed at the fourth apex to position the second end of the adjustment roller at the fourth distance from the tension roller.

10. The image forming apparatus according to claim 1, further comprising:

a frame that supports the tension roller; and a nip forming lever that is pivotally mounted to the frame, wherein the nip forming lever rotatably supports the nip roller, and wherein the nip forming lever contacts the nip forming cam to pivot the nip roller toward and away from the endless belt when the nip forming cam rotates.

11. The image forming apparatus according to claim 10, further comprising:

a tension applying lever to move the adjustment roller relative to the tension roller;

a biasing member coupled with the tension applying lever to bias the adjustment roller away from the tension roller; and a tension adjustment lever coupled between the tension adjustment cam and the tension applying lever to move the adjustment roller relative to the tension roller when the tension adjustment cam rotates.

12. An image forming apparatus comprising:

an endless belt to rotate;

belt rollers including a tension roller and an adjustment roller extending in a longitudinal direction inside the endless belt;

a nip roller extending adjacent the endless belt to form a nip between the nip roller and the endless belt;

a nip forming device to move the nip roller between a pressed position wherein the nip roller is pressed against the endless belt, and a retracted position wherein the nip roller is retracted from the endless belt; and a tension adjustment device to correct a misalignment of the endless belt in the longitudinal direction when the endless belt rotates, the tension adjustment device to tilt the adjustment roller relative to the tension roller when the nip roller is in the pressed position and when the nip roller is in the retracted position, wherein the tension adjustment device includes:

a first apex to move the adjustment roller toward the tension roller when the nip forming device positions the nip roller in the pressed position; and a second apex to move the adjustment roller toward the tension roller when the nip forming device positions the nip roller in the retracted position.

13. The image forming apparatus according to claim 12, wherein the nip forming device includes a nip forming cam that is rotatable to displace the nip roller between the pressed position and the retracted position, wherein the adjustment roller includes a first end and a second end opposite the first end in the longitudinal direction, and wherein the tension adjustment device includes a first tension adjustment cam to move the first end of the adjustment roller toward and away from the tension roller, and a second tension adjustment cam to move the second end of the adjustment roller toward and away from the tension roller.

14. The image forming apparatus according to claim 13, further comprising:

a cam shaft including the nip forming cam, the first tension adjustment cam and the second tension adjustment cam that are arranged in the longitudinal direction along the cam shaft, wherein the nip forming cam has a contact surface extending in a rotational direction of the cam shaft, wherein the contact surface includes a nip forming surface region to position the nip roller in the pressed position, and a retraction surface region to position the nip roller in the retracted position, wherein the first tension adjustment cam forms the first apex that is positioned to move the first end of the adjustment roller when the nip forming cam positions the nip roller in the pressed position, wherein the second tension adjustment cam forms the second apex that is positioned to move the second end of the adjustment roller when the nip forming cam positions the nip roller in the pressed position, wherein the first tension adjustment cam forms a third apex located opposite the first apex relative to a rotation axis of the cam shaft, to move the first end of the adjustment roller when the nip forming cam positions the nip roller in the retracted position, and wherein the second tension adjustment cam forms a fourth apex located opposite the second apex relative to the rotation axis of the cam shaft, to move the second end of the adjustment roller when the nip forming cam positions the nip roller in the retracted position.

* * * * *